US007113716B2

(12) United States Patent
Tomatsu

(10) Patent No.: US 7,113,716 B2
(45) Date of Patent: Sep. 26, 2006

(54) WRINKLE PREVENTED THERMAL FIXING DEVICE AND IMAGE FORMING APPARATUS

(75) Inventor: Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 239 days.

(21) Appl. No.: 10/799,634

(22) Filed: Mar. 15, 2004

(65) Prior Publication Data

US 2004/0234290 A1 Nov. 25, 2004

(30) Foreign Application Priority Data

Mar. 14, 2003 (JP) ..... 2003-070559

(51) Int. Cl.
*G03G 15/20* (2006.01)

(52) U.S. Cl. ..... 399/67; 399/68; 399/69; 399/329

(58) Field of Classification Search ..... 399/67, 399/322, 328, 329, 331, 333, 68, 69
See application file for complete search history.

(56) References Cited

U.S. PATENT DOCUMENTS 4,315,682 A * 2/1982 Parzanici ..... 399/322
5,245,393 A * 9/1993 Storlie et al. ..... 399/322
5,255,060 A 10/1993 Chikano
5,623,331 A * 4/1997 Kaneko et al. ..... 399/328
5,893,019 A * 4/1999 Yoda et al. ..... 399/328
5,987,294 A * 11/1999 Yoda et al. ..... 399/328

FOREIGN PATENT DOCUMENTS

| | | |
|---|---|---|
| JP | A 63-85777 | 4/1988 |
| JP | A 5-6118 | 1/1993 |
| JP | A 10-31388 | 2/1998 |
| JP | A 10-222002 | 8/1998 |
| JP | A 2001-175114 | 6/2001 |

* cited by examiner

*Primary Examiner*—William J. Royer
(74) *Attorney, Agent, or Firm*—Oliff & Berridge, PLC

(57) ABSTRACT

A thermal fixing device includes: a fixing member configured to be in contact with a fixation medium; a first pressing member disposed to face the fixing member and presses the fixation medium to the fixing member; a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member.

29 Claims, 10 Drawing Sheets

WRINKLE PREVENTED THERMAL FIXING DEVICE AND IMAGE FORMING APPARATUS

BACKGROUND

The present invention relates to a thermal fixing device and an image forming apparatus including the thermal fixing device.

An image forming apparatus such as a laser printer is generally provided with a thermal fixing device including a heat roller and a pressure roller, and a toner transferred onto a sheet is thermally fixed during a period when the sheet passes between the heat roller and the pressure roller.

In such a thermal fixing device, there is known one in which in order to increase a contact area between a heat roller and a sheet and to achieve quick and certain fixation, plural pressure rollers are provided in a conveyance direction of the sheet.

However, when the plural pressure rollers are provided, as the contact area of the sheet with the heat roller is increased, a curved portion along the curvature of the heat roller is increased. Thus, there is a disadvantage that for example, in the case where an envelope formed of a double paper or the like is fixed, a shift in the amount of conveyance occurs between its front sheet coming in contact with the heat roller and its back sheet coming in contact with the pressure roller, and wrinkles are apt to occur.

Thus, for example, JP-A-5-006118 proposes that a nip width of each of the pressure rollers to a fixing roller is made 2.5 mm or less to prevent wrinkles from occurring when an envelope is fixed.

SUMMARY

However, even if the nip width of each of the pressure rollers is made 2.5 mm or less, this is insufficient to prevent the occurrence of wrinkles sufficiently.

One of objects of the invention is to provide a thermal fixing device that can prevent the occurrence of wrinkles of a fixation medium, and an image forming apparatus including the thermal fixing device.

In order to achieve the above object, according to a first aspect of the invention, there is provided a thermal fixing device including: a fixing member configured to be in contact with a fixation medium; a first pressing member disposed to face the fixing member and press the fixation medium to the fixing member; a second pressing member disposed to face the fixing member at a position downstream in a conveyance direction of the fixation medium with respect to the first pressing member and press the fixation medium to the fixing member; and a changeover unit configured to change over a pressing force per unit area of at least one of the first pressing member and the second pressing member.

According to a second aspect of the invention, there is provided a thermal fixing device including: a fixing member configured to be in contact with a fixation medium; a first pressing member disposed to face the fixing member and press the fixation medium to the fixing member; and a second pressing member disposed to face the fixing member at a position downstream in a conveyance direction of the fixation medium with respect to the first pressing member and press the fixation medium to the fixing member, wherein a friction coefficient of the second pressing member to the fixation medium is equal to or larger than a friction coefficient of the first pressing member to the fixation medium.

According to a third aspect of the invention, there is provided an image forming apparatus including: a sheet feeding section configured to feed a sheet as a fixation medium; and an image forming section having a thermal fixing device and configured to form an image on the sheet fed by the sheet feeding section, wherein the thermal fixing device includes: a fixing member configured to be in contact with a fixation medium; a first pressing member disposed to face the fixing member and press the fixation medium to the fixing member; a second pressing member disposed to face the fixing member at a position downstream in a conveyance direction of the fixation medium with respect to the first pressing member and press the fixation medium to the fixing member; and a changeover unit configured to change over a pressing force per unit area of at least one of the first pressing member and the second pressing member.

According to a fourth aspect of the invention, there is provided an image forming apparatus including: a sheet feeding section configured to feed a sheet as a fixation medium; and an image forming section having a thermal fixing device and configured to form an image on the sheet fed by the sheet feeding section, wherein the thermal fixing device includes: a fixing member configured to be in contact with a fixation medium; a first pressing member disposed to face the fixing member and press the fixation medium to the fixing member; and a second pressing member disposed to face the fixing member at a position downstream in a conveyance direction of the fixation medium with respect to the first pressing member and press the fixation medium to the fixing member, wherein a friction coefficient of the second pressing member to the fixation medium is equal to or larger than a friction coefficient of the first pressing member to the fixation medium.

BRIEF DESCRIPTION OF THE DRAWINGS

These and other objects and advantages of the present invention will become more fully apparent from the following detailed description taken with the accompanying drawings, in which.

DETAILED DESCRIPTION OF EMBODIMENTS

Referring now to the accompanying drawings, a description will be given in detail of a preferred embodiment of the invention.

Figure 1:
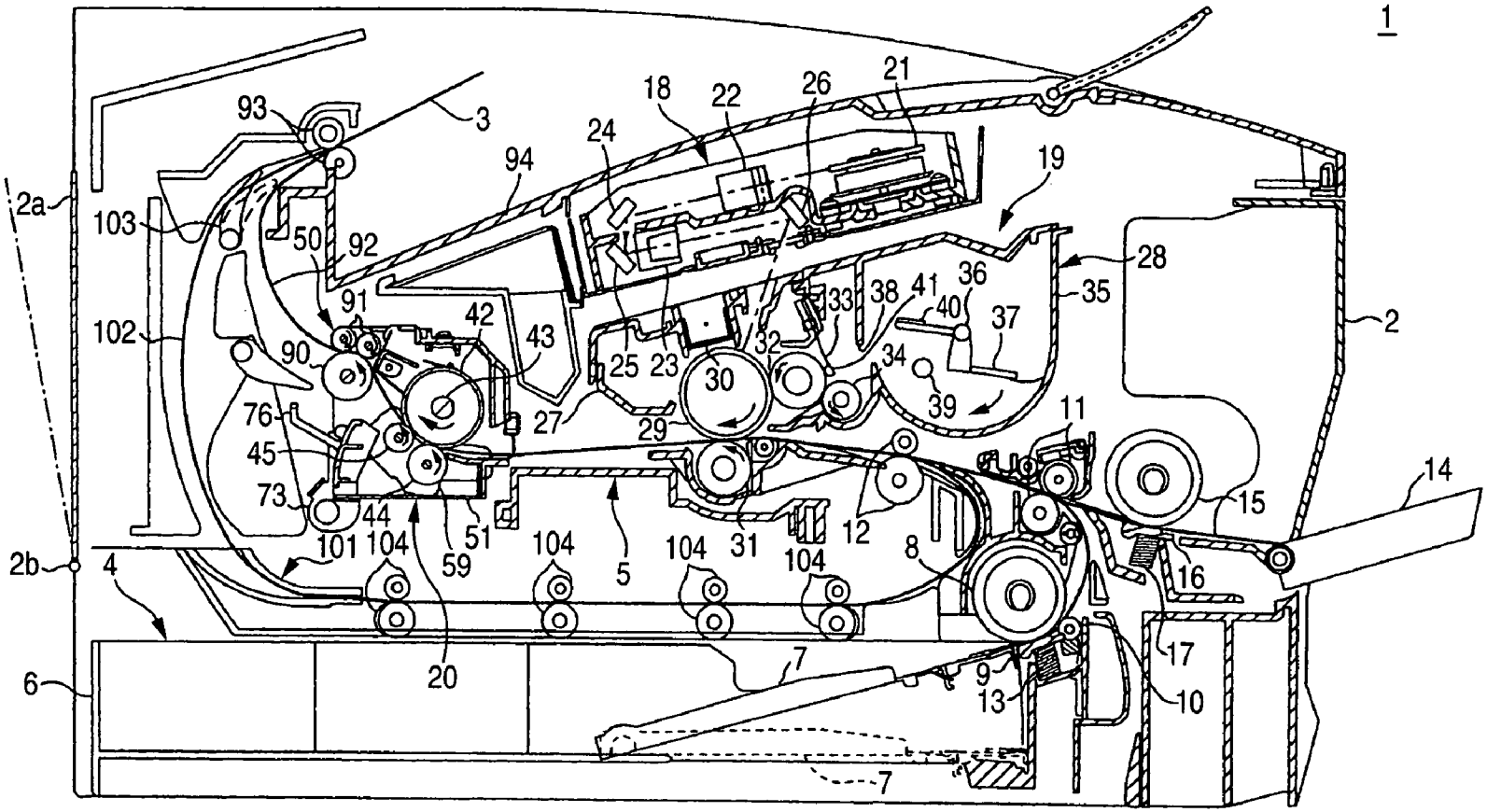
FIG. 1 is a main part side sectional view showing an embodiment of a laser printer as an image forming apparatus of the invention.

FIG. 1 is a main part side sectional view showing an embodiment of a laser printer as an image forming apparatus of the invention. In FIG. 1, a laser printer 1 includes a sheet feeding section 4 for feeding a sheet 3 as a fixation medium, an image forming section 5 for forming an image on the fed sheet 3, and the like in a main body casing 2.

In the following description, as to the main body casing 2, a side where a multipurpose tray 14 is provided is called a front side, and a side where a rear cover 2*a* is provided is called a rear side.

The sheet feeding section 4 includes a sheet feed tray 6, a sheet press plate 7 provided in the sheet feed tray 6, a sheet feed roller 8 and a sheet feed part 9 which are provided above one end side end part of the sheet feed tray 6, paper dust removal rollers 10 and 11 provided downstream in a conveyance direction of the sheet 3 (hereinafter, the downstream in the conveyance direction of the sheet 3 is simply referred to as "conveyance direction downstream", and the upstream side in the conveyance direction of the sheet 3 is simply referred to as "conveyance direction upstream side", and a description will be made) with respect to the sheet feed roller 8, and a registration roller 12 provided at the conveyance direction downstream with respect to the paper dust removal rollers 10 and 11.

The sheet press plate 7 can be stacked with the sheets 3 in a laminate state, and is swingably supported at a farther end with respect to the sheet feed roller 8 so that a nearer end can be moved vertically, and is urged upward by a not-shown spring from its backside. Thus, as the amount of stacking of the sheets 3 is increased, the sheet press plate 7 is swung downward against the urging force of the spring, while the farther end with respect to the sheet feed roller 8 is made a fulcrum. The sheet feed roller 8 and the sheet feed part 9 are disposed to face each other, and the sheet feed part 9 is pressed to the sheet feed roller 8 by a spring 13 provided at the backside of the paper sheet part 9.

The uppermost sheet 3 on the sheet press plate 7 is pressed toward the sheet feed roller 8 from the backside of the sheet press plate 7 by a not-shown spring, and after the sheet is held between the sheet feed roller 8 and the sheet feed part 9, the sheet feed roller 8 is rotated, so that the sheets 3 are fed one by one. Then, the paper dust on the fed sheet 3 is removed by the paper dust removal rollers 10 and 11, and then, the sheet is fed to the registration roller 12.

The registration roller 12 has a pair of rollers, and sends the sheet 3 to an image formation position after registration. Incidentally, the image formation position is a transfer position where a toner image on a photosensitive drum 29 is transferred to the sheet 3, and is, in this embodiment, a contact position between the photosensitive drum 29 and a transfer roller 31.

The sheet feeding section 4 includes the multipurpose tray 14, a multipurpose side sheet feed roller 15 for feeding the sheet 3 stacked on the multipurpose tray 14 and a multipurpose side sheet feed part 16. The multipurpose side sheet feed roller 15 and the multipurpose side sheet feed part 16 are disposed to face each other, and the multipurpose side sheet feed part 16 is pressed to the multipurpose side sheet feed roller 15 by a spring 17 provided at the backside of the multipurpose side sheet feed part 16. The sheet 3 stacked on the multipurpose tray 14 is held between the multipurpose side sheet feed roller 15 and the multipurpose side sheet feed part 16 by the rotation of the multipurpose side sheet feed roller 15, and then, the sheets 3 are fed one by one. Then, the fed sheet 3 is sent to the registration roller 12 after the paper dust thereon is removed by the paper dust removal roller 11.

The image formation section 5 includes a scanner part 18, a process part 19, a fixing part 20 as a thermal fixing device, and the like.

The scanner part 18 is provided at an upper part in the main body casing 2, and includes a laser emission part (not shown), a polygon mirror 21 driven to be rotated, lenses 22 and 23, reflecting mirrors 24, 25 and 26, and the like. A laser beam emitted from the laser emission part and based on image data passes through or is reflected by the polygon mirror 21, the lens 22, the reflecting mirrors 24 and 25, the lens 23 and the reflecting mirror 26 in sequence as indicated by a chain line, and is irradiated onto the surface of the photosensitive drum 29 of the process part 19 by high speed scanning.

The process part 19 is disposed below the scanner part 18, and includes, in a drum cartridge 27 detachably mounted to the main body casing 2, a development cartridge 28, the photosensitive drum 29, a scorotron type charging unit 30, the transfer roller 31 and the like.

The development cartridge 28 is detachably mounted to the drum cartridge 27, and includes a developing roller 32, a layer thickness regulating blade 33, a supply roller 34, a toner hopper 35 and the like.

The toner hopper 35 is filled with, as a developing agent of a medium to be fixed, a positive charging nonmagnetic one-component toner. As the toner, a polymerized toner is used which is obtained by copolymerizing a polymerizable monomer, for example, styrene monomer such as styrene, or acrylic monomer such as acrylic acid, alkyl (C1 to C4) acrylate, or alkyl (C1 to C4) methacrylate by a well-known polymerization method such as suspension polymerization. The polymerized toner as stated above has roughly a spherical-letter shape and excellent fluidity. Therefore, high quality image formation can be achieved by using the polymerized toner.

The toner as stated above is mixed with wax or a coloring agent such as carbon black, and is added with an additive such as silica in order to improve the fluidity. The particle diameter of the toner is in a range from 6 μm to 10 μm.

In the laser printer 1, there is used a toner having a glass transition point (Tg) of, for example, 70° C. and a softening point of, for example, 120° C.

The toner in the toner hopper 35 is agitated in an arrow direction (clockwise direction) by an agitator 37 supported by a rotation shaft 36 provided at the center of the toner hopper 35, and is discharged through a toner supply port 38 opening to the supply roller 34 from the toner hopper 35. Both side walls of the toner hopper 35 are provided with windows 39 for detection of the residual amount of toner, and the residual amount of the toner in the toner hopper 35 can be detected. The window 39 is cleaned by a cleaner 40 supported by the rotation shaft 36.

The supply roller 34 is rotatably disposed at a facing position of the opposite side to the toner hopper 35 with respect to the toner supply port 38, and the developing roller 32 is rotatably disposed to face the supply roller 34. The supply roller 34 and the developing roller 32 are in contact with each other in such a state that they are respectively compressed in some degree.

The supply roller 34 is such that a roller made of conductive foam material covers a roller shaft made of metal, and is driven to be rotated in an arrow direction (counterclockwise direction) by a motor 85 (see FIG. 4) as a driving unit.

The developing roller 32 is such that a roller made of conductive rubber material covers a roller shaft made of metal. More specifically, the roller of the developing roller 32 is such that the surface of a roller main body made of conductive urethane rubber or silicone rubber containing carbon fine particles or the like is covered with a coat layer of urethane rubber containing fluorine or silicone rubber. At the time of development, a development bias is applied to the developing roller 32 from a not-shown power source, and the roller is driven to be rotated in an arrow direction (counterclockwise direction) by the motor 85 (see FIG. 4).

The layer thickness regulating blade 33 is disposed in the vicinity of the developing roller 32. The layer thickness regulating blade 33 includes a press part 41 made of insulating silicone rubber and having a semicircular section at a tip part of a blade main body made of a metal plate spring member, and is supported by the development cartridge 28 in the vicinity of the developing roller 32, and the press part 41 is provided so as to be pressed onto the developing roller 32 by the elastic force of the blade main body.

The toner discharged from the toner supply port 38 is supplied to the developing roller 32 by the rotation of the supply roller 34, and is positively charged at this time by the friction between the supply roller 34 and the developing roller 32, and further, the toner supplied onto the developing roller 32 enters between the press part 41 of the layer thickness regulating blade 33 and the developing roller 32 in accordance with the rotation of the developing roller 32, and is supported as a thin layer having a specified thickness on the developing roller 32.

The photosensitive drum 29 is rotatably supported at a facing position of an opposite side to the supply roller 34 with respect to the developing roller 32 and in the drum cartridge 27. The photosensitive drum 29 includes a grounded drum main body, its surface is formed of a positively-charged photosensitive layer made of polycarbonate or the like, and the photosensitive drum 29 is driven to be rotated in an arrow direction (clockwise direction) by the motor 85 (see FIG. 4).

The scorotron type charging unit 30 is disposed above the photosensitive drum 29 to face it and to be spaced therefrom by a specified interval so as not to come in contact with the photosensitive drum 29. The scorotron type charging unit 30 is a scorotron type charging unit for positive charging and for generating corona discharge from a charging wire of tungsten or the like, and is provided to uniformly and positively charge the surface of the photosensitive drum 29 by application of voltage from a not-shown power source.

The transfer roller 31 is disposed below the photosensitive drum 29 to face the photosensitive drum 29, and is rotatably supported by the drum cartridge 27. The transfer roller 31 is such that a roller made of conductive rubber material covers a roller shaft made of metal, and at the time of transfer, a transfer bias is applied from a not-shown power source, and the transfer roller 31 is driven to be rotated in an arrow direction (counterclockwise direction) by the motor 85 (see FIG. 4).

The surface of the photosensitive drum 29 is first charged uniformly and positively by the scorotron type charging unit 30 with the rotation of the photosensitive drum 29, and next, an electrostatic latent image is formed by a laser beam from the scanner part 18, and then, the photosensitive drum 29 faces the developing roller 32. When the toner supported on the developing roller 32 and positively charged faces and comes in contact with the photosensitive drum 29, the toner is supplied to the electrostatic latent image formed on the surface of the photosensitive drum 29, that is, to the exposed portion of the uniformly positively charged photosensitive drum 29, which is exposed by the laser beam and whose potential is lowered, and the toner is selectively supported, so that the toner image is formed on the surface of the photosensitive drum 29. As a result, reversal development is achieved.

Thereafter, the toner image supported on the surface of the photosensitive drum 29 is transferred to the sheet 3 by a transfer bias applied to the transfer roller 31 while the sheet 3 passes between the photosensitive drum 29 and the transfer roller 31.

Figure 2:
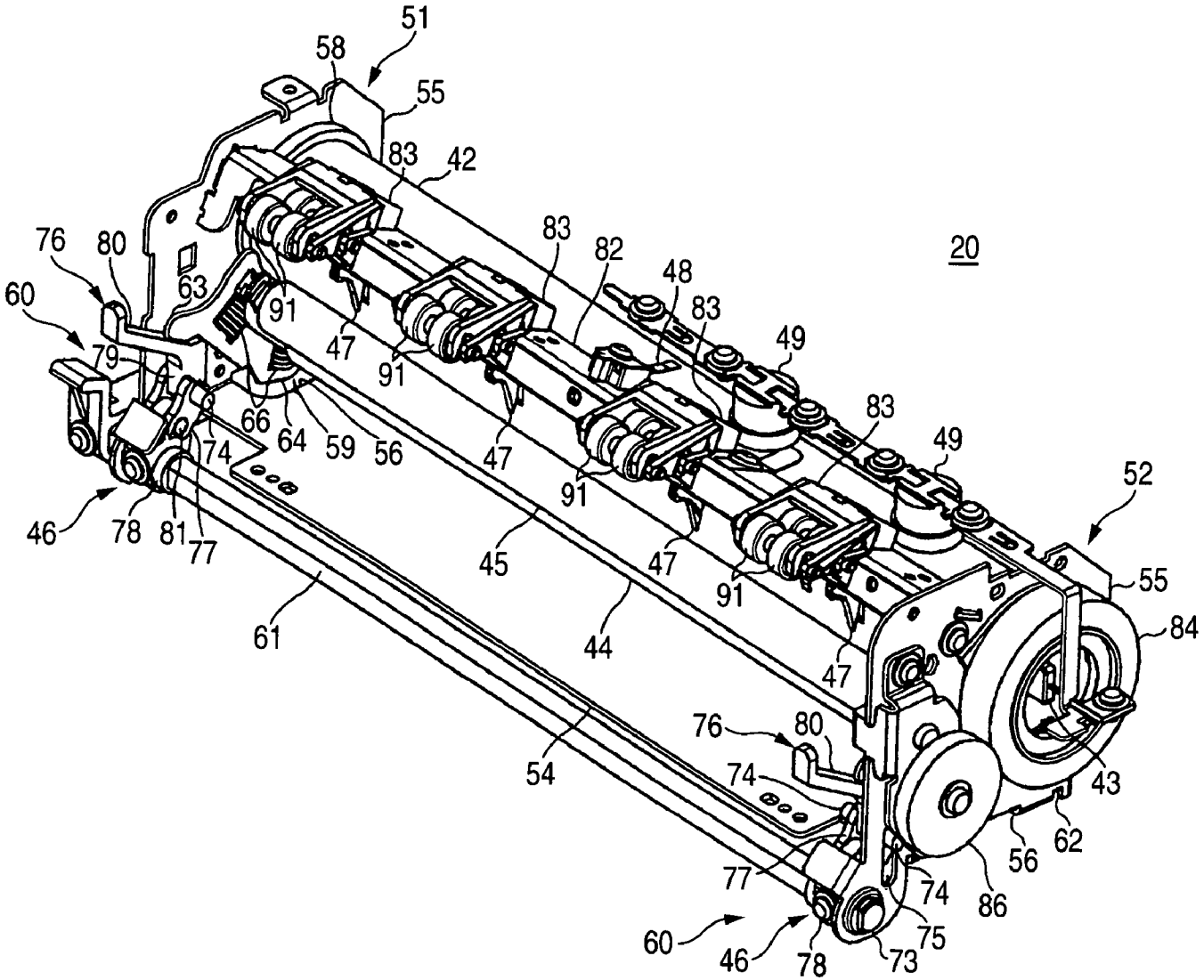
FIG. 2 is a main part perspective view showing a state where an upper frame of a fixing part of the laser printer shown in FIG. 1 is removed.
Figure 4:
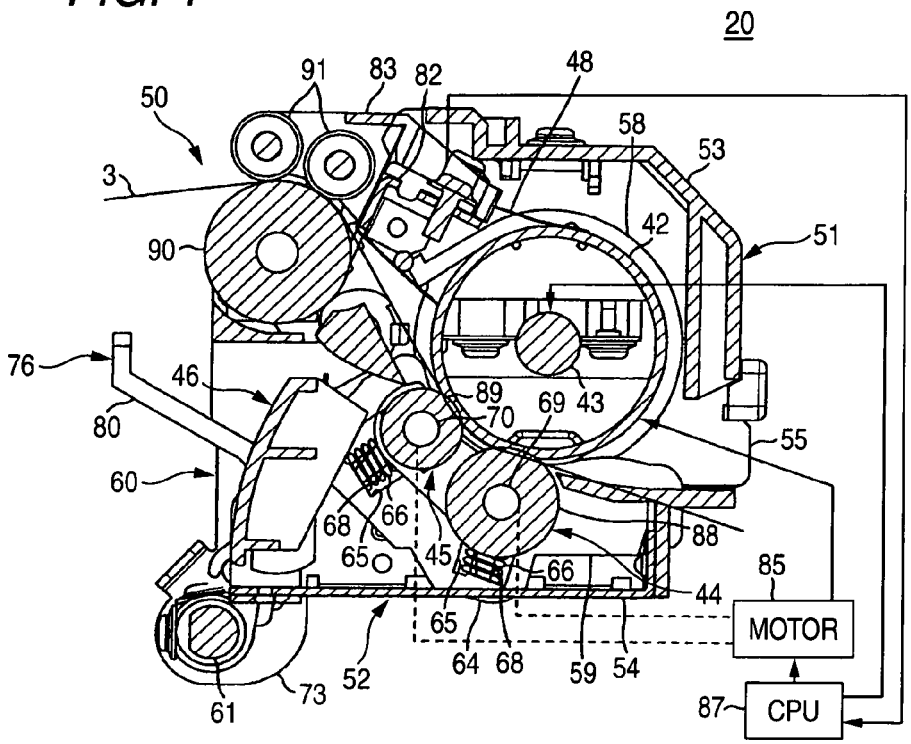
FIG. 4 is a sectional view (normal mode) corresponding to line IV—IV of FIG. 3.
Figure 5:
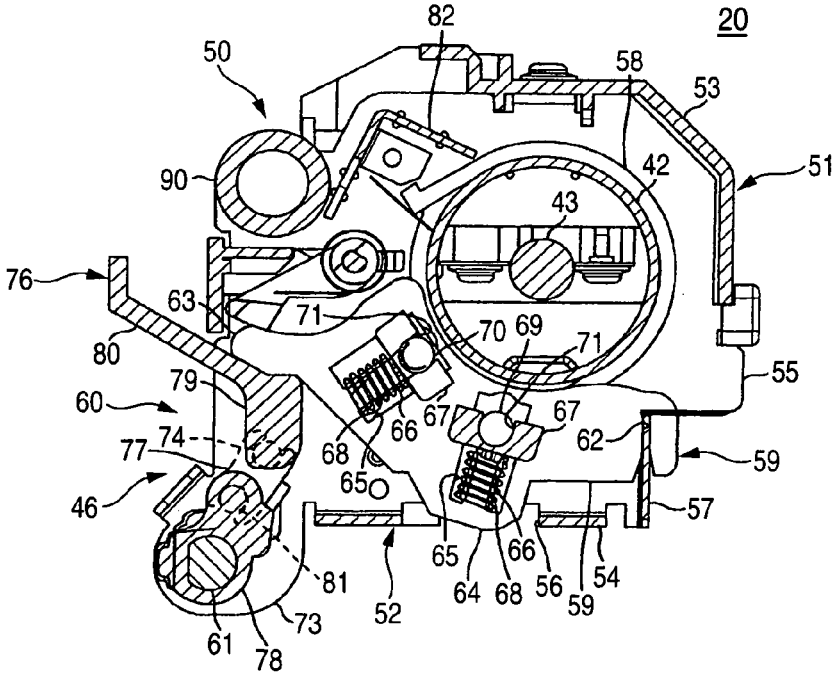
FIG. 5 is a sectional view (normal mode) corresponding to line V—V of FIG. 3.

The fixing part 20 is disposed at the conveyance direction downstream with respect to the process part 19, and includes, as shown in FIGS. 2, 4 and 5, a heat roller 42 as a fixing member and a fixing roller, a fixing heater 43 as a heating unit, a first pressure roller 44 as a first pressing member, a second pressure roller 45 as a second pressing member, a pressure changeover mechanism part 46 as a changeover unit, plural (four, in the embodiment) peeling pawls 47, a thermistor 48 as a temperature detecting unit, plural (two, in the embodiment) thermostats 49, and a conveyance mechanism part 50, and these are supported by a fixation frame 51.

Figure 3:
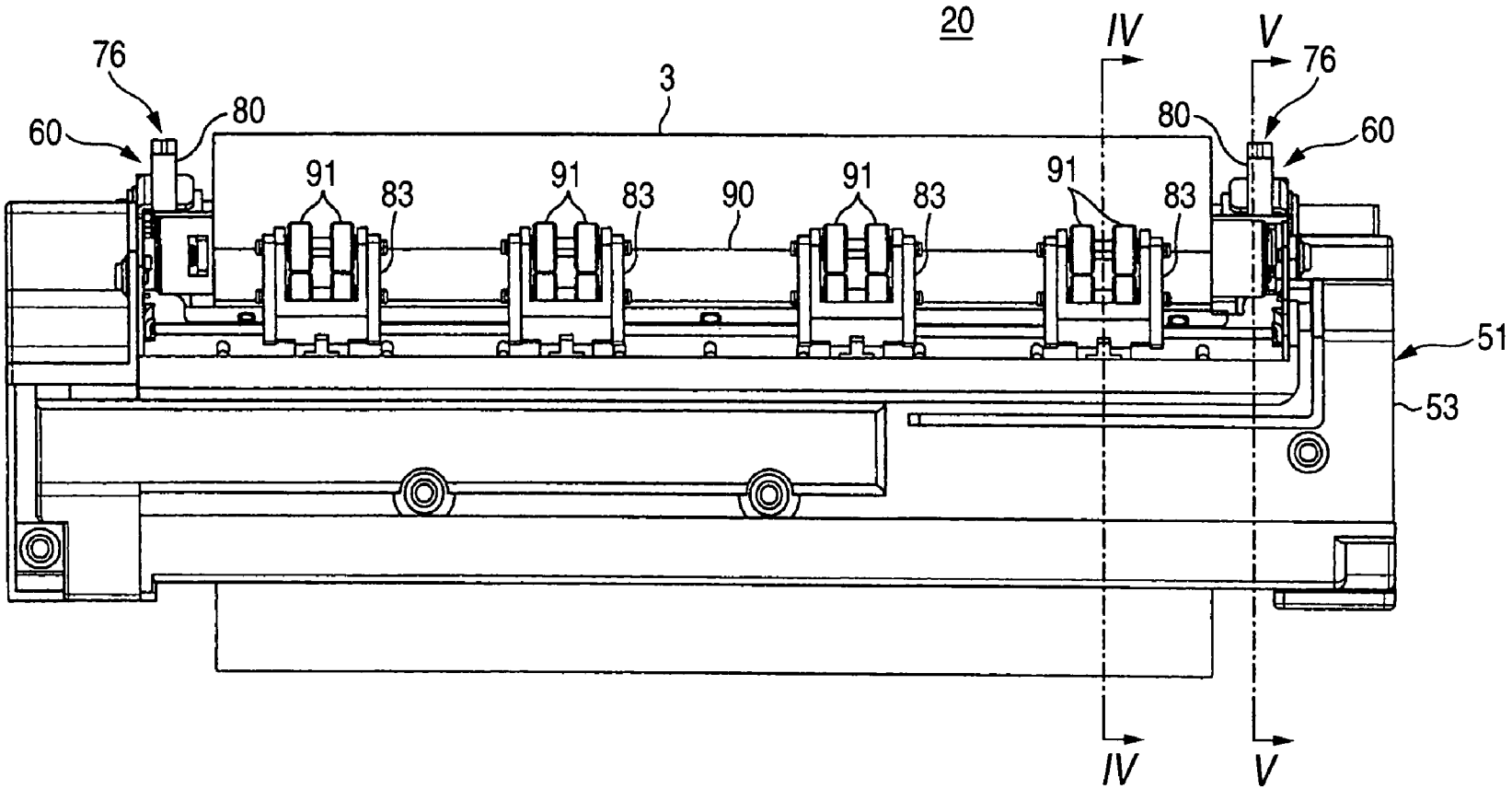
FIG. 3 is a plan view of the fixing part shown in FIG. 2.

The fixation frame 51 includes, as shown in FIGS. 2 and 5, a lower frame 52 having substantially a C-letter shape when viewed in front, and includes, as shown in FIGS. 3 and 5, an upper frame 53 covering the lower frame 52 from above and having substantially an L-letter shape when viewed from a side.

The lower frame 52 includes, as shown in FIG. 2, a bottom plate 54, and two side plates 55 standing upward from both sides of the bottom plate 54 in a width direction (direction orthogonal to a front-to-rear direction when viewed in front).

The bottom plate 54 is disposed below the heat roller 42 and along the axial direction of the heat roller 42. At both the sides of the bottom plate 54 in the width direction, as shown in FIG. 5, there are formed cutout parts 56 for receiving lower expansion parts 64 of after-mentioned holder plates 59 so as to allow their advance and retreat. At front end parts of the bottom plate 54 at both the sides in the width direction, support plates 57 as supporting members for supporting front end parts of the holder plates 59 are formed to stand upward.

The respective side plates 55 are, as shown in FIG. 2, formed to face each other at both sides of the heat roller 42 in the axial direction, and bearing members 58 for rotatably supporting the heat roller 42 are respectively provided at the respective side plates 55. Each of the bearing members 58 is formed into a ring shape having an inner diameter corresponding to an outer diameter of the heat roller 42 so that the outer peripheral surface of the heat roller 42 can be rotatably borne. Each of the bearing members 58 is formed of a material (for example, polyphenylene sulfide: melting point of 280° C.) which is softened when the temperature exceeds the thermal fixation temperature at which the toner image transferred onto the sheet 3 is thermally fixed.

A shaft support part 73 provided with a support hole for rotatably supporting an after-mentioned interlocking shaft 61 is formed at a rear side lower end part of each of the side plates 55 so as to expand downward. Besides, a long hole 75 for slidably receiving an after-mentioned swing shaft 74 is formed in the vicinity of the front of each of the shaft support parts 73 and in the vertical direction.

An erection plate 82 laid between the respective side plates 55 is provided at the lower frame 52. The erection plate 82 has, as shown in FIG. 5, a substantially L-letter shaped section, is disposed between the heat roller 42 and an after-mentioned conveyance roller 90 in the conveyance direction of the sheet 3, and is supported, as shown in FIG. 2, between the respective side plates 55 so that its longitudinal direction is parallel to the axial direction of the heat roller 42.

Pinch roller support parts 83 for supporting after-mentioned pinch rollers 91 of the conveyance mechanism part 50 are provided at this erection plate 82. The plural (four) pinch roller support parts 83 are provided at specified intervals along the axial direction of the heat roller 42.

At the lower frame 52, a heat roller drive gear 84 externally fitted to the bearing member 58 and an input gear 86 which is disposed at the side of the heat roller drive gear 84 to engage with the heat roller drive gear 84 and to which power from the motor 85 (see FIG. 4) is inputted are provided at one of the side plates 55.

As shown in FIGS. 3 and 5, an upper frame 53 is attached to the respective side plates 55 of the lower frame 52 so as to cover the front and the upper part of the heat roller 42.

The heat roller 42 is formed into a cylindrical shape by drawing of metal such as aluminum, and a coating layer of fluorocarbon polymer, for example, polytetrafluoroethylene is provided on its outer peripheral surface.

The surface roughness Rz of the coating layer is configured to be 1.2.

With respect to the heat roller 42, as shown in FIG. 2, both end parts thereof in the axial direction are press inserted in the bearing members 58, and it is connected to the motor 85 through the input gear 86 and the heat roller drive gear 84 as shown in FIG. 4. Accordingly, when power is inputted from the motor 85 through the input gear 86 and the heat roller drive gear 84, the heat roller 42 is driven to be rotated in an arrow direction (clockwise direction, see FIG. 1).

The motor 85 is connected to a CPU 87 as a controller, and the rotation speed of the heat roller 42 is controlled through the control of the motor 85 by the CPU 87, whereby the conveyance speed of the sheet 3 held between the heat roller 42 and the first pressure roller 44 and the second pressure roller 45 is set.

The CPU 87 includes therein a ROM storing a program and a RAM temporarily storing data.

The fixing heater 43 is made of a halogen heater or the like for generating heat by applied electricity, is disposed at the axial center in the heat roller 42, and is provided along the axial direction of the heat roller 42 in order to heat the heat roller 42. The fixing heater 43 is, as shown in FIG. 4, connected to the CPU 87, the drive or stop thereof is controlled by the CPU 87, and the surface of the heat roller 42 is kept at a set thermal fixation temperature.

The first pressure roller 44 and the second pressure roller 45 are provided below the heat roller 42 so as to face the heat roller 42 and to be spaced from each other by a specified interval along the conveyance direction of the sheet 3.

The first pressure roller 44 is such that a first roller layer 88 made of heat resistant rubber material covers a first roller shaft 69 made of metal. The first roller layer 88 is coated with a tube of polytetrafluoroethylene which is the same material as the coating layer of the heat roller 42. More specifically, the diameter of the first roller shaft 69 is made, for example, 10 mm, and the roller diameter of the first roller layer 88 is made, for example, 16.5 mm. The rubber material forming the first roller layer 88 has a hardness in a range of from 50 to 55 in Asker C hardness and in a range of from 0° to 10° in JIS A hardness. The surface roughness Rz of the surface of the first pressure roller 44 is made, for example, 0.8.

As to this first pressure roller 44, as described later in FIG. 5, each of axial end parts of the first roller shaft 69 is inserted in a pressure roller attachment groove 65 at the front side of each of the holder plates 59, and is held in a recess part 71 of a pressure receiving member 67. Besides, when the heat roller 42 is driven to be rotated, the first pressure roller 44 follows the rotation driving of the heat roller 42 and is rotated in an arrow direction (counterclockwise direction, see FIG. 1).

As shown in FIG. 4, the second pressure roller 45 is such that a second roller layer 89 made of heat resistant rubber material covers a second roller shaft 70 made of metal. The second roller layer 89 is coated with a tube of polytetrafluoroethylene which is the same material as the coating layer of the heat roller 42. More specifically, the diameter of the second roller shaft 70 is made, for example, 8 mm, and the roller diameter of the second roller layer 89 is made smaller than the roller diameter of the first roller layer 88, for example, 12 mm. The rubber material forming the second roller layer 89 has a hardness in a range of, for example, from 50 to 55 in Asker C hardness and in a range of from 0° to 10° in JIS A hardness.

The surface roughness Rz of the second pressure roller 45 is configured to be, for example, 1.0.

As to this second pressure roller 45, as described later in FIG. 5, each of axial end parts of the second roller shaft 70 is inserted in a pressure roller attachment groove 65 of each of the holder plates 59 at its rear side, and is held in a recess part 71 of a pressure receiving member 67. When the heat roller 42 is driven to be rotated, the second pressure roller 45 follows the rotation driving of the heat roller 42 and is rotated in an arrow direction (counterclockwise direction, see FIG. 1).

Figure 10:
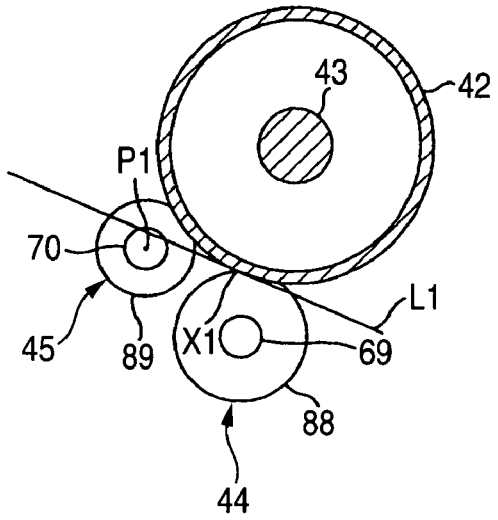
FIG. 10 is a schematic sectional view for explaining the disposition of a second pressure roller in the fixing part shown in FIG. 2.

The second pressure roller 45 supported as described above is disposed downstream in the conveyance direction of the sheet 3 with respect to the first pressure roller 44, more specifically, is disposed downstream in the rotation direction of the heat roller 42 along the peripheral direction of the heat roller 42 and is spaced from the first pressure roller 44 by a specified interval. As shown in FIG. 10, with respect to a tangent line L1 of the heat roller 42 at a most downstream position X1 of a contact portion between the heat roller 42 and the first pressure roller 44 in the conveyance direction of the sheet 3, a rotation center P1 of the second pressure roller 45 is disposed at a farther side from the heat roller 42.

As described above, when the two rollers of the first pressure roller 44 and the second pressure roller 45 are provided for the one heat roller 42, the contact area of the sheet 3 to the heat roller 42 can be increased. Thus, the sheet 3 can be quickly fixed, and the speed-up of thermal fixation (for example, about 100 mm/sec in printing speed) can be realized. Since the contact area of the sheet 3 to the heat roller 42 can be increased without enlarging the pressure roller, miniaturization can be realized.

In the fixing part 20, the hardness of the surface of the first pressure roller 44 coming in contact with the sheet 3 is set to be higher than the hardness of the surface of the second pressure roller 45 coming in contact with the sheet 3 by selecting the diameter of the first roller shaft 69 of the first pressure roller 44, the roller diameter of the first roller layer 88, the hardness of the rubber material forming the first roller layer 88, the diameter of the second roller shaft 70 of the second pressure roller 45, the roller diameter of the second roller layer 89, and the hardness of the rubber material forming the second roller layer 89.

As shown in FIGS. 2, 4 and 5, the pressure changeover mechanism part 46 includes the holder plates 59 as the holding member, operation lever parts 60, the interlocking shaft 61 as a coupling member, and the like.

Figure 16A:
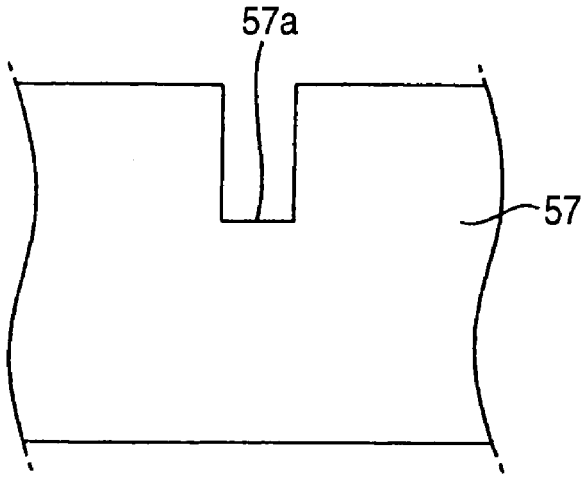
FIG. 16A is a front view of a support plate of the fixing part.
Figure 16B:
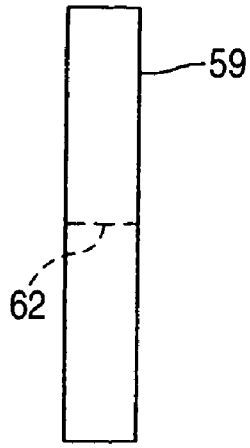
FIG. 16B is a front view of a holder plate of the fixing part.

The holder plate 59 is disposed below the heat roller 42, an upper side peripheral part thereof is formed into a curved shape along the outer peripheral surface of the heat roller 42 when viewed from a side, and it is provided at each of the side plates 55. A locking groove 62 (see FIG. 16B) capable of engaging with a locked groove 57*a* (see FIG. 16A) formed in the support plate 57 of the lower frame 52 and opening to the above is formed at the front end part of each of the holder plates 59, a rear side protrusion part 63 coming in contact with an after-mentioned lever 76 is formed at the rear end part thereof, and the lower expansion part 64 to be received in the cutout part 56 of the lower frame 52 is formed at the halfway lower end part in the front-to-rear direction, and they are integrally formed. The pressure roller attachment grooves 65 corresponding to the first pressure roller 44 and the second pressure roller 45 are respectively formed in the inside thereof to be spaced from each other by a specified interval in the front-to-rear direction.

Figure 7:
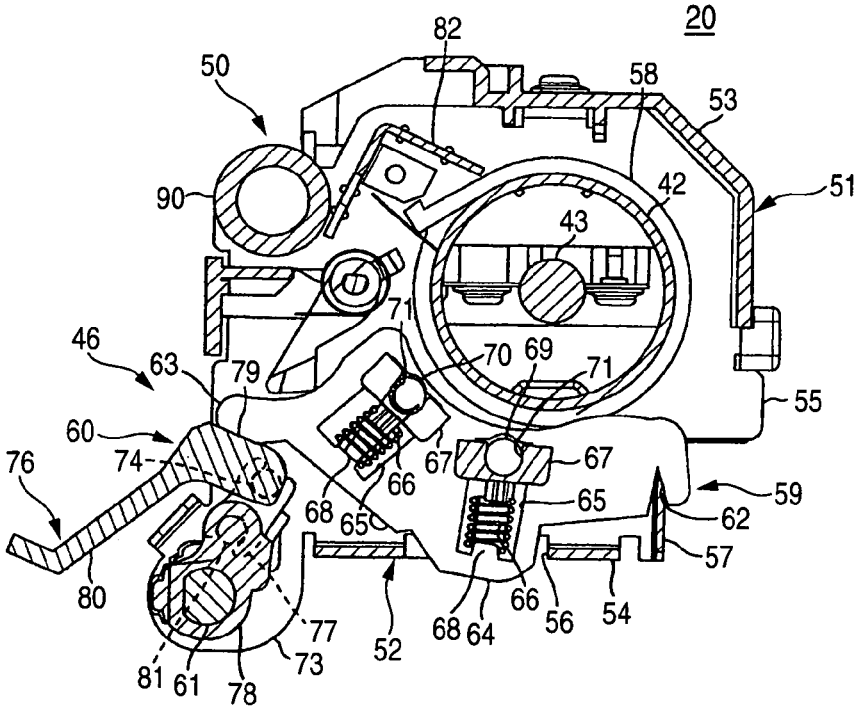
FIG. 7 is a sectional view (envelope mode) corresponding to the line V—V of FIG. 3.

The locking groove 62 is formed at the front end part to have substantially an inverted V-letter shape with an opened lower part when viewed from a side (see FIG. 7). The rear side protrusion part 63 is formed so as to protrude from the rear end part of the holder plate 59 toward the rear side. Besides, the lower expansion part 64 is formed so as to expand from the lower end part to form a substantially rectangular shape so that the formation of the front side pressure roller attachment groove 65 can be ensured.

The respective pressure roller attachment grooves 65 are formed to be parallel to each other in the front-to-rear direction and to be spaced from each other by the specified interval in the inside of the holder plate 59.

A spring 66 and the pressure receiving member 67 are provided in each of the pressure roller attachment grooves 65. That is, a locking projection 68 extending toward the rotation center of the heat roller 42 is provided at the deepest part in each of the pressure roller attachment grooves 65, and the spring 66 is externally fitted to the locking projection 68. The recess part 71 for receiving the first roller shaft 69 of the first pressure roller 44 or the second roller shaft 70 of the second pressure roller 45 is formed in each of the pressure receiving members 67, and each of the pressure receiving members 67 is attached to the free end of each of the springs 66.

Each of the holder plates 59 receives the first roller shaft 69 of the first pressure roller 44 in the front side pressure roller attachment groove 65, and elastically holds the first roller shaft 69 on the recess part 71 of the pressure receiving member 67. Each of the holder plates 59 receives the second roller shaft 70 of the second pressure roller 45 in the rear side pressure roller attachment groove 65, and elastically holds the second roller shaft 70 on the recess part 71 of the pressure receiving member 67. In this state, the locking groove 62 of the front end part is inserted to the locked groove 57*a* of the support plate 57 of the lower frame 52, the bottom of the locking groove 62 comes in contact with the bottom of the locked groove 57*a*, and each of the holder plates 59 is swingably supported with respect to each of the side plates 55 while the contact part is made a fulcrum. That is, each of the holder plates 59 is supported to be capable of coming in contact with and being separated from the heat roller 42. By locking between the locking groove 62 and the locked groove 57*a*, the movement of each of the holder plates 59 with respect to each of the side plates 55 is restricted in the direction orthogonal to the sheet conveyance direction. The lower expansion part 64 of the lower end part of each of the holder plates 59 is inserted to the cutout part 56 in such a manner that it can freely advance and retreat, and in the state where the rear side protrusion 63 of the rear end part thereof is in contact with the lever 76, it is swingably supported at each of the side plates 55 while its front end part is made a fulcrum.

The operation lever part 60 is provided at each of the side plates 55 to face the holder plate 59 at the rear side.

Each of the operation lever parts 60 includes the lever 76 as a swinging member, a link member 77, a cam member 78 and the like.

In the lever 76, a substantially rectangular base part 79 and an operation rod 80 as an operation member extending from the base part 79 obliquely rearward are integrally formed. A swing shaft 74 engaged with an opening part of one end part of the link member 77 described next is formed at the lower end part of the base part 79 of this lever 76 so as to protrude toward the inside and the outside in the direction orthogonal to the sheet conveyance direction.

The link member 77 is formed into a substantially rectangular shape in which both sides thereof in the longitudinal direction are opened to have a substantially C-letter shape.

The cam members 78 are provided at both ends of the after-mentioned interlocking shaft 61 in the axial direction so that relative rotation is impossible around the interlocking shaft 61, and an engagement shaft 81 engaged with the opening part of the other end part of the link member 77 is formed so as to protrude to the inside and the outside in the direction orthogonal to the sheet conveyance direction.

As shown in FIG. 2, at the inside of each of the side plates 55 in the direction orthogonal to the sheet conveyance direction, and in the state where the rear side protrusion 63 of the holder plate 59 is brought into contact with the upper surface of the base part 79 of the lever 76, the swing shaft 74 extending to the outside of the base part 79 is inserted in the long hole 75 of the side plate 55. In this state, the link member 77 is disposed at each of both sides of the base part 79 of the lever 76 and the cam member 78 in the width direction, the opening part of one end of the outside link member 77 is engaged with the swing shaft 74 extending outward between the side plate 55 and the base part 79, and the opening part of the other end is engaged with the engagement shaft 81 extending to the outside of the cam member 78. The opening part of one end of the inside link member 77 is engaged with the swing shaft 74 extending inward, and the opening part of the other end part is engaged with the engagement shaft 81 extending inward.

The interlocking shaft 61 is disposed at the rear side of a bottom wall 54 of the lower frame 52 so as to be laid between the side plates 55, and both end parts in the longitudinal direction are rotatably supported at the shaft support parts 73 of the respective side plates 55. Besides, as described before, the cam member 78 is provided at the inside of each of the side plates 55 so that it cannot be rotated relatively to the interlocking shaft 61.

In the pressure changeover mechanism part 46, the pressure forces per unit areas of the first pressure roller 44 and the second pressure roller 45 to the heat roller 42 can be changed over between a normal mode as a first state in which a normal paper or the like as the sheet 3 is fixed, an envelope mode as a second state in which an envelope or the like as the sheet 3 is fixed, and a release mode in which the pressures of the first pressure roller 44 and the second pressure roller 45 to the heat roller 42 are released.

In the following description, the changeover of the normal mode, the envelope mode and the release mode is performed in such a way that the rear cover 2*a* provided at the rear side of the main body casing 2 is put in an opening state, and the operation rod 80 of the lever 76 is operated from the opening part. As indicated by an imaginary line of FIG. 1, the rear cover 2*a* is provided such that its lower end can be freely opened and closed to the main body casing 2 through a hinge 2*b*.

In order to cause the normal mode, as shown in FIG. 5, the operator holds the operation rod 80 of each of the levers 76, and raises the operation rod 80 while swinging it forward. Then, the swing shaft 74 of the lever 76 slides upward in the long hole 75 of the side plate 55, the upper surface of the base part 79 comes in contact with the rear side protrusion 63 of the holder plate 59, and the rear side protrusion 63 is pressed upward. Accordingly, the holder plate 59 is swung so that the rear end part is moved upward while the front end part is made a fulcrum. As a result, as shown in FIG. 4, the first pressure roller 44 and the second pressure roller 45 are elastically held in the state where they are pressed to the heat roller 42 by the urging forces of the springs 66.

In the normal mode, setting is made such that the load of the first pressure roller 44 to the heat roller 42 becomes, for example, 6×9.8 N, the contact area between the heat roller 42 and the first pressure roller 44 becomes, for example, 4 mm in the conveyance direction of the sheet 3 and 210 mm in the axial direction of the heat roller 42, that is, the pressing force per unit area of the first pressure roller 44 to the heat roller 42 becomes, for example, (6×9.8)/(4×210) N/mm2.

In the normal mode, setting is made such that the pressing force per unit area of the second pressure roller 45 to the heat roller 42 is equal to or smaller than the pressing force per unit area of the first pressure roller 44 to the heat roller 42.

More specifically, setting is made such that the load of the second pressure roller 45 to the heat roller 42 is smaller than the load of the first pressure roller 44 to the heat roller 42, for example, 3×9.8 N, the contact area between the heat roller 42 and the second pressure roller 45 is smaller than the contact area between the heat roller 42 and the first pressure roller 44, for example, 2.2 mm in the conveyance direction of the sheet 3 and 210 mm in the axial direction of the heat roller 42, that is, the pressing force per unit area of the second pressure roller 45 to the heat roller 42 becomes, for example, (3×9.8)/(2.2×210) N/mm2.

Figure 6:
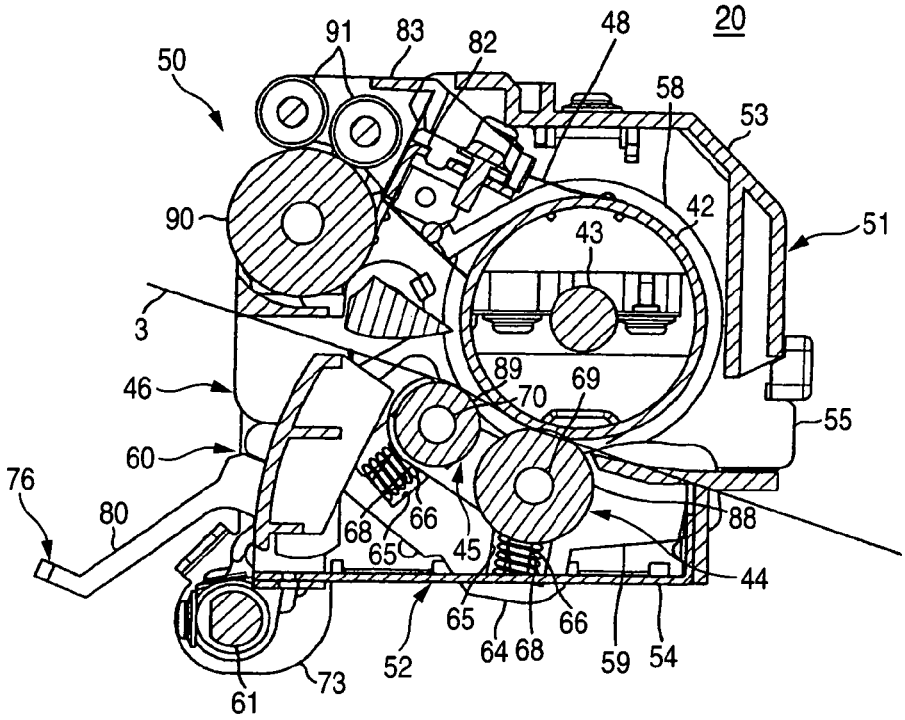
FIG. 6 is a sectional view (envelope mode) corresponding to the line IV—IV of FIG. 3.

In order to cause the envelope mode, as shown in FIG. 7, the operator holds the operation rod 80 of each of the levers 76, and swings the operation rod 80 rearward from the normal mode. Then, the swing shaft 74 of the lever 76 is rotated while the long hole 75 of the side plate 55 is made a fulcrum, the side of the base part 79 comes in contact with the rear side protrusion 63 of the holder plate 59, and the rear side protrusion 63 is slightly moved downward. Accordingly, the holder plate 59 is swung so that its rear end part is slightly moved downward while the front end part is made a fulcrum. As a result, as shown in FIG. 6, since the holder plate 59 is swung while the front end part at the conveyance direction upstream side with respect to the first roller shaft 69 of the first pressure roller 44 held at the front side pressure roller attachment groove 65 is made a fulcrum, the second pressure roller 45 is displaced more than the first pressure roller 44, and the second pressure roller 45 is separated from the heat roller 42 in the state where the first pressure roller 44 presses the heat roller 42.

In the envelope mode, setting is made such that both the pressing force per unit area of the first pressure roller 44 to the heat roller 42 and the pressing force per unit area of the second pressure roller 45 to the heat roller become low as compared with the normal mode, and in the first pressure roller 44, the load of the first pressure roller 44 to the heat roller 42 becomes, for example, 3×9.8 N, which is half of that in the normal mode, and the contact area between heat roller 42 and the first pressure roller 44 becomes, for example, 2.4 mm in the conveyance direction of the sheet 3 and 210 mm in the axial direction of the heat roller 42, that is, the pressing force per unit area of the first pressure roller 44 to the heat roller 42 becomes, for example, (3×9.8)/(2.4×210) N/mm2.

In the second pressure roller 45, since it is separated from the heat roller 42, setting is made such that the load of the second pressure roller 45 to the heat roller 42 becomes 0 N, and the contact area between heat roller 42 and the second pressure roller 45 becomes 0 mm2, that is, the pressing force per unit area of the second pressure roller 45 to the heat roller 42 becomes 0 N/mm2.

In the envelope mode, since the second pressure roller 45 is separated from the heat roller 42, setting may be made such that the ratio of the pressing force per unit area of the second pressure roller 45 in the envelope mode to the pressing force per unit area of the second pressure roller 45 in the normal mode becomes smaller than the ratio of the pressing force per unit area of the first pressure roller 44 in the envelope mode to the pressing force per unit area of the first pressure roller 44 in the normal mode, and it is not always necessary that the second pressure roller 45 is separated from the heat roller 42.

Figure 8:
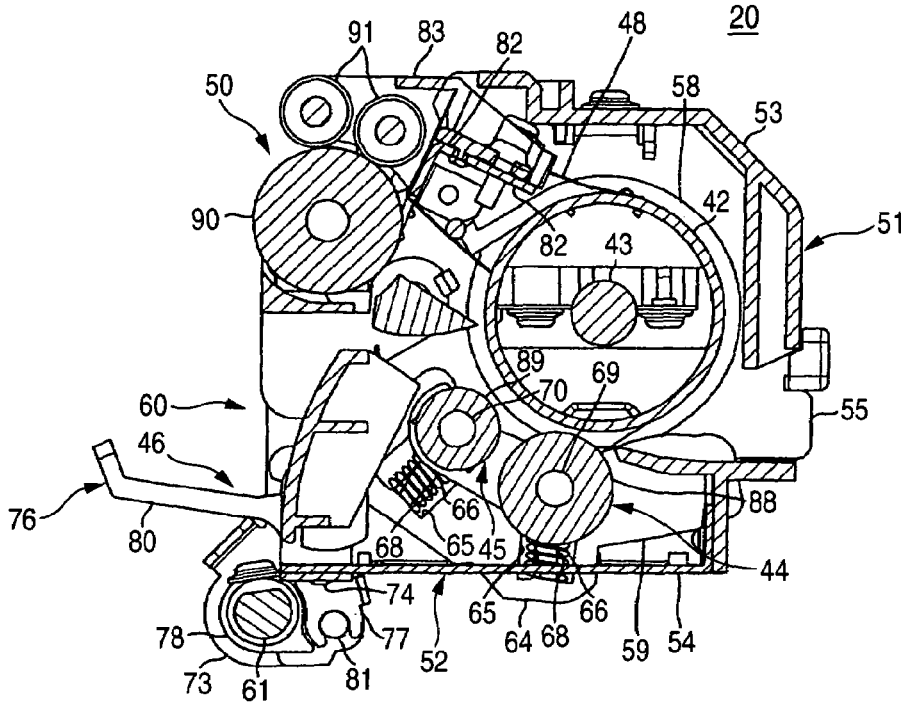
Figure 9:
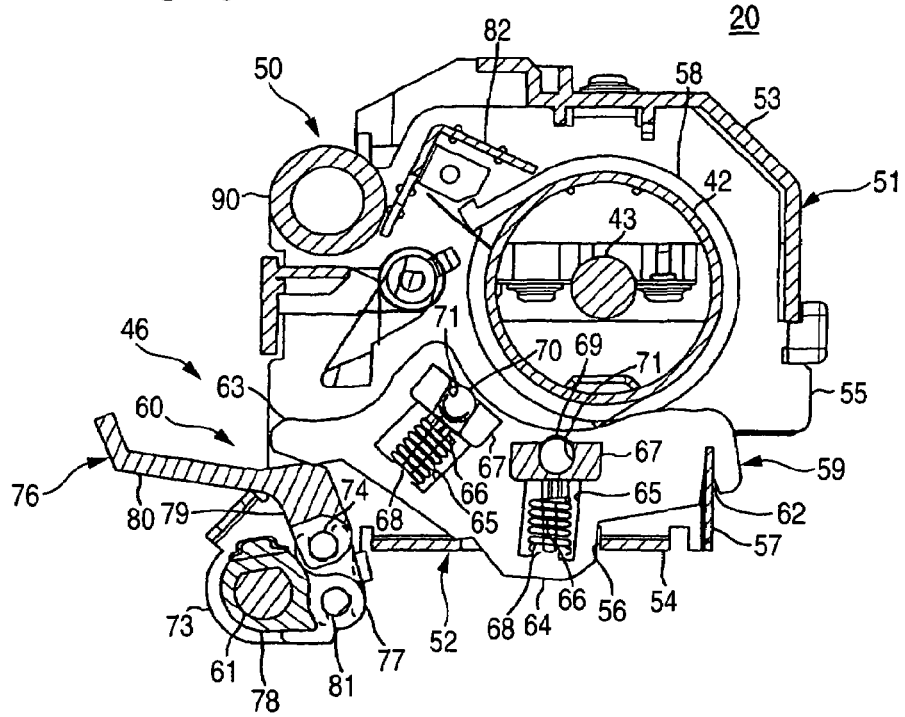
FIG. 9 is a sectional view (release mode) corresponding to the line V—V of FIG. 3.

In order to cause the release mode, as shown in FIG. 9, the operator holds the operation rod 80 of either one of the levers 76, and presses the operation rod 80 downward while swinging it rearward slightly. Then, in the state where the rear side protrusion 63 of the holder plate 59 is in contact with an inclined surface between the upper surface and the side surface of the base part 79, the swing shaft 74 of the lever 76 slides downward in the long hole 75 of the side plate 55, so that the rear side protrusion 63 is moved downward. Accordingly, the holder plate 59 is swung so that the rear end part is moved downward while the front end part is made a fulcrum, and accordingly, as shown in FIG. 8, the pressures of the first pressure roller 44 and the second pressure roller 45 to the heat roller 42 are released.

In the release mode, when the swing shaft 74 of the lever 76 slides downward in the long hole 75 of the side plate 55, since the contact shaft 81 of the cam member 78 is pressed downward through the link member 77, the interlocking shaft 61 to which the cam member 78 is provided to be unable to perform relative rotation is rotated. Thus, in the release mode, when either one of the levers 76 is operated, even if both the levers 76 are not operated, the respective bearing members 58 are interlocked by the rotation of the interlocking shaft 61 and the release mode can be realized.

As shown in FIG. 2, the plural (four, in the embodiment) peeling pawls 47 are disposed at positions where the respective pinch roller support parts 83 are provided on the erection plate 82 of the lower frame 52 and so as to swing to be capable of coming in contact with and separating from the heat roller 42 in the state where they face the heat roller 42 from the conveyance direction downstream to the upstream side.

The thermistor 48 is a contact type temperature sensor, and is formed to have elasticity and a flat rectangular shape, and its base end is supported at the erection plate 82 so that its free end comes in contact with the surface of the heat roller 42 at the upstream side of the contact portion between the heat roller 42 and the first pressure roller 44 in the rotation direction of the heat roller 42 and at the axial direction center portion of the heat roller 42.

The thermistor 48 is connected to the CPU 87 as shown in FIG. 4, detects the surface temperature of the heat roller 42, and inputs a detection signal to the CPU 87. The CPU 87 controls the drive and stop of the fixing heater 43 on the basis of the detection signal from the thermistor 48, and keeps the surface temperature of the heat roller 42 at a set thermal fixation temperature.

As shown in FIG. 2, two thermostats 49 are provided along the axial direction at the upstream side of the contact portion between the heat roller 42 and the first pressure roller 44 in the rotation direction of the heat roller 42. Each of the thermostats 49 includes a bimetal deformed by heat, and when the fixing heater 43 does not normally operate due to erroneous operation of the CPU 87 or a circuit and the surface of the heat roller 42 is overheated to a temperature exceeding the set thermal fixation temperature, the thermostats 49 cut off the energization to the fixing heater 47 by thermal deformation of the bimetal, to thereby prevent the overheat of the heat roller 42.

In the fixing part 20, even in the case where the bimetal is not deformed by heat in each of the thermostats 49, when the temperature reaches a point at which the bearing member 58 is melted by further overheat of the surface of the heat roller 42, the bearing member 58 is softened, so that the heat roller 42 is moved upward by the urging force due to the pressing from the first pressure roller 44 and the second pressure roller 45, and the bimetal is mechanically deformed by this, and accordingly, the energization to the fixing heater 43 can be cut off.

As shown in FIG. 4, the conveyance mechanism part 50 is disposed at the conveyance direction downstream with respect to the heat roller 42 and the first pressure roller 44 and the second pressure roller 45, and includes the conveyance roller 90 and the plural pinch rollers 91 disposed above the conveyance roller 90 to face it.

The conveyance roller 90 is such that a roller layer made of rubber material covers a roller shaft made of metal, and is disposed to face the heat roller 42 through the erection plate 82 in the conveyance direction of the sheet 3. Although not shown in FIG. 2, a roller shaft is inserted in the respective side plates 55, so that the conveyance roller 90 is rotatably supported between the side plates 55 along the axial direction of the heat roller 42. When power is inputted from the motor 85 (see FIG. 4), the conveyance roller 90 is driven to be rotated in an arrow direction (counterclockwise direction, see FIG. 1).

As shown in FIG. 2, plural (two, in the embodiment) pairs of the pinch rollers 91 are provided at each of the pinch roller support parts 83 of the erection plate 82, so that they sequentially face and come in contact with the conveyance roller 90 from above in the conveyance direction of the sheet 3.

In the fixing part 20, as shown in FIG. 1, during a period when the sheet 3 conveyed from the transfer position is made to sequentially pass through while being held between the heat roller 42 and the first pressure roller 44 and the second pressure roller 45, the toner image transferred onto the sheet 3 is thermally fixed, and then, in the normal mode, as shown in FIG. 4, the sheet 3 is conveyed while being held between the conveyance roller 90 and the pinch rollers 91 in the conveyance mechanism part 50, and is conveyed to a paper ejection path 92. In the envelope mode, the rear cover 2*a* is put in the open state, and as shown in FIG. 6, the sheet 3 is made to pass through substantially linearly, below the conveyance roller 90 of the conveyance mechanism part 50, from between the heat roller 42 and the second pressure roller 45, and is taken out from the opening part of the rear cover 2*a*.

In the fixing part 20, in the case where the thermal fixation is performed in the above normal mode, the thermal fixing temperature as the first temperature is set to be, for example, 180° C. through the control of the fixing heater 43 by the CPU 87, and the conveyance speed of the sheet 3 as the first conveyance speed is set to be, for example, 140 mm/sec through the control of the motor 85 by the CPU 87. Besides, in the case where the thermal fixation is performed in the above envelope mode, the thermal fixing temperature as the second temperature is set to be higher than the thermal fixing temperature in the normal mode, for example, 220° C. through the control of the fixing heater 43 by the CPU 87, and the conveyance speed of the sheet 3 as the second conveyance speed is set to be lower than the conveyance speed in the normal mode, for example, 70 mm/sec through the control of the motor 85 by the CPU 87.

Thereafter, as shown in FIG. 1, the sheet 3 sent to the paper ejection path 92 is sent to a paper ejection roller 93, and is ejected to a paper ejection tray 94 by the paper ejection roller 93.

In the laser printer 1, as shown in FIG. 1, in order to form images on both sides of the sheet 3, a reversal conveyance part 101 is provided. This reversal conveyance part 101 includes the paper ejection roller 93, a reversal conveyance path 102, a flapper 103 and plural reversal conveyance rollers 104.

The paper ejection roller 93 is made of a pair of rollers, and is provided so that the forward rotation and the reverse rotation can be changed. As described above, in the case where the sheet 3 is ejected onto the paper ejection tray 94, the paper ejection roller 93 is rotated in the forward direction, and in the case where the sheet 3 is reversed, the paper ejection roller 93 is rotated in the reverse direction.

The reversal conveyance path 102 is provided along the vertical direction so that the sheet 3 can be conveyed from the paper ejection roller 93 to the plural reversal conveyance rollers 104 disposed below the image formation part 5, its upstream side end is disposed near the paper ejection roller 93, and a downstream end thereof is disposed near the reversal conveyance roller 104.

The flapper 103 is swingably provided to face a branch portion between the paper ejection path 92 and the reversal conveyance path 102, and is provided to be capable of changing the conveyance direction of the sheet 3 reversed by the paper ejection roller 93 from the direction toward the paper ejection path 92 to the direction toward the reversal conveyance path 102 by excitation or non-excitation of a not-shown solenoid.

The plural reversal conveyance rollers 104 are provided above the sheet feed tray 6 in the substantially horizontal direction, the reversal conveyance roller 104 at the most upstream side is disposed near the rear end of the reversal conveyance path 102, and the reversal conveyance roller 104 at the most downstream is disposed below the registration roller 12.

In the case where images are formed on both sides of the sheet 3, this reversal conveyance part 101 is operated as follows. That is, when the sheet 3 on one side of which an image is formed is sent by the conveyance mechanism part 50 from the paper ejection path 92 to the paper ejection roller 93, the paper ejection roller 93 is forward rotated in a state where it holds the sheet 3, and once conveys this sheet 3 to the outside (side of the paper ejection tray 94), and when most of the sheet 3 is sent to the outside and the rear end of the sheet 3 is held by the paper ejection roller 93, the forward rotation is stopped. Next, the paper ejection roller 93 is reversely rotated, the flapper 103 changes the conveyance direction so that the sheet 3 is conveyed to the reversal conveyance path 102, and the sheet 3 is conveyed to the reversal conveyance path 102 in a state where the front and the rear are reversed. When the conveyance of the sheet 3 is ended, the flapper 103 is changed into the original state, that is, the state in which the sheet 3 sent from the conveyance mechanism part 50 is sent to the paper ejection roller 93. Next, the sheet 3 conveyed to the reversal conveyance path 102 in the reverse direction is conveyed to the reversal conveyance rollers 104, and is sent from the reversal conveyance rollers 104 to the registration roller 12 while being reversed upward. The sheet 3 conveyed to the registration roller 12 is again sent, in the reversed state, to the image formation position after registration, and accordingly, images are formed on both the sides of the sheet 3.

In the fixing part 20, setting is made such that in the normal mode, by the above thermal fixation conditions (for example, the thermal fixation temperature, the conveyance speed of the sheet 3, the pressing force per unit area of the first pressure roller 44 to the heat roller 42, and the like), the temperature of an interface between the toner and the sheet 3 at the most downstream position X1 (see FIG. 10), in the conveyance direction of the sheet 3, of the contact portion between the heat roller 42 and the first pressure roller 44 becomes a temperature not lower than the glass transition point (for example, 70° C.) of the toner, and further, a temperature not lower than the softening point (for example, 120° C.).

According to the setting as described above, at the most downstream position X1, in the conveyance direction of the sheet 3, of the contact portion between the heat roller 42 and the first pressure roller 44, since the temperature of the interface between the sheet 3 and the toner becomes the temperature not lower than the glass transition point of the toner, further, the temperature not lower than the softening point, the temperature of the toner on the sheet 3 pressed by the first pressure roller 44 becomes the temperature not lower than the glass transition point of the toner, further, the temperature not lower than the softening point at the most downstream position X1, in the conveyance direction of the sheet 3, of the contact portion between the heat roller 42 and the first pressure roller 44.

Accordingly, at the point of time when the sheet has passed between the heat roller 42 and the first pressure roller 44, most of the toner can be firmly fixed to the sheet 3. Thus, when the sheet 3 enters between the heat roller 42 and the second pressure roller 45, since the toner is almost fixed on the sheet 3, an image shift is hard to cause. As a result, while the image shift is prevented, quick and excellent fixation can be achieved by the first pressure roller 44 and the second pressure roller 45.

As more specific thermal fixation conditions, in the fixing part 20, as described above, the diameter of the first roller layer 88 of the first pressure roller 44 is set to become larger than the diameter of the second roller layer 89 of the second pressure roller 45, and the hardness of the surface of the first pressure roller 44 coming in contact with the sheet 3 is set to be larger than the hardness of the surface of the second pressure roller 45 coming in contact with the sheet 3, and further, in the normal mode, the load of the first pressure roller 44 to the heat roller 42 is set to be larger than the load of the second pressure roller 45 to the heat roller 42. By this, in the normal mode, the pressing force per unit area of the second pressure roller 45 to the heat roller 42 is set to be lower than the pressing force per unit area of the first pressure roller 44 to the heat roller 42.

Accordingly, at the point of time when the sheet has passed between the heat roller 42 and the first pressure roller 44, the toner can be more firmly fixed on the sheet 3. Thus, when the sheet 3 next enters between the heat roller 42 and the second pressure roller 45, the image shift is hard to cause. As a result, while the image shift is prevented, quick and excellent fixation can be achieved by the first pressure roller 44 and the second pressure roller 45.

In the fixing part 20, by the above thermal fixation conditions, setting is made such that immediately after the sheet 3 has passed through between the heat roller 42 and the first pressure roller 44, a cold offset does not occur, and immediately after the sheet 3 has passed through between the heat roller 42 and the second pressure roller 45, a hot offset does not occur.

Figure 11:
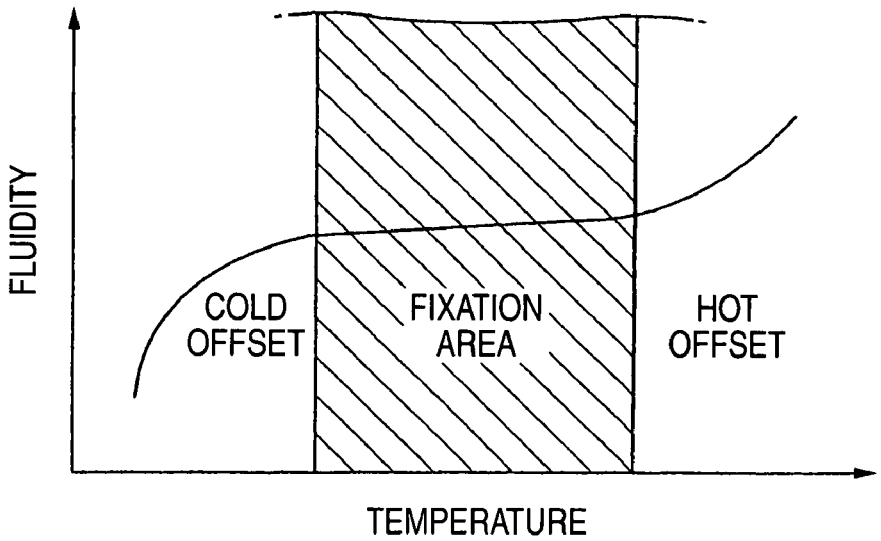
FIG. 11 is a correlation view showing a relation between fluidity of toner and temperature.

That is, as shown in FIG. 11 in which a general relation between fluidity of toner and temperature is plotted, the toner has a thermal fixation area intrinsic to the toner, and when it becomes lower than that, melting of the toner becomes insufficient, and the cold offset occurs in which the toner on the sheet 3 remains on the sheet 3 in some area, and is adhered to the heat roller 42 in some area. Besides, when it becomes higher than the thermal fixation area, the toner is excessively melted, and the toner is split on the sheet 3, and the hot offset occurs in which one toner is split and adhered to both the sheet 3 and the heat roller 42.

However, in the fixing part 20, by the above thermal fixation conditions, at the point of time when the sheet has passed between the heat roller 42 and the first pressure roller 44, the toner is firmly fixed on the sheet 3, and therefore, immediately after the sheet 3 has passed between the heat roller 42 and the first pressure roller 44, it is possible to prevent the cold offset from occurring.

In the fixing part 20, by the above thermal fixation conditions, at the point of time when the sheet has passed between the heat roller 42 and the first pressure roller 44, most of the toner is fixed on the sheet 3, and therefore, it is not necessary to excessively heat the toner to fix it on the sheet 3 between the heat roller 42 and the second pressure roller 45. Accordingly, immediately after the sheet 3 has passed between the heat roller 42 and the second pressure roller 45, it is possible to prevent the hot offset from occurring. As a result, at the point of time when the sheet 3 has passed between the heat roller 42 and the second pressure roller 45, the toner is fixed on the sheet 3, and therefore, certain fixation of the toner to the sheet 3 can be achieved by the first pressure roller 44 and the second pressure roller 45. In the fixing part 20, setting is made such that the temperature of the interface between the sheet 3 and the toner at the point of time when the sheet has passed between the heat roller 42 and the second pressure roller 45 becomes, for example, 160° C.

As described above, when the first pressure roller 44 and the second pressure roller 45 are provided in the fixing part 20, as described above, the speed-up of thermal fixation and the miniaturization can be realized, and on the other hand, since a curved portion of the sheet 3 along the curvature of the heat roller 42 is increased, in the case where as the sheet 3, for example, an envelope is printed instead of a normal paper, a shift in the amount of conveyance occurs between a front sheet coming in contact with the heat roller 42 and a back sheet coming in contact with the first pressure roller 44 and the second pressure roller 45, and wrinkles are apt to occur.

However, in the laser printer 1, in the case where the envelope as the sheet 3 is printed, as described above, in the fixing part 20, when the normal mode is changed over to the envelope mode, both the pressing force per unit area of the first pressure roller 44 to the heat roller 42 and the pressing force per unit area of the second pressure roller 45 to the heat roller 42 become low in the envelope mode, and therefore, the normal paper or the like is certainly fixed in the normal mode, and the envelope or the like can be fixed in the envelope mode while the occurrence of wrinkles is prevented.

Especially, in the fixing part 20, in the case where the envelope is fixed in the envelope mode, while excellent fixation is performed by the first pressure roller 44, the pressing force per unit area of the second pressure roller 45 is made zero, and the occurrence of wrinkles can be prevented.

Further, in the fixing part 20, in the case where thermal fixation is made in the envelope mode, setting is made such that the thermal fixation temperature in the envelope mode becomes higher than the thermal fixation temperature in the normal mode through the control of the fixing heater 43 by the CPU 87.

Thus, in the envelope mode, even if the pressing forces per unit areas of the first pressure roller 44 and the second pressure roller 45 are lower than those in the normal mode, the higher fixation temperature is ensured and excellent fixation can be achieved.

In the fixing part 20, in the case where thermal fixation is performed in the envelope mode, setting is made such that the conveyance speed in the envelope mode becomes lower than the conveyance speed in the normal mode through the control of the motor 85 by the CPU 87.

Thus, in the envelope mode, even if the pressing forces in unit areas of the first pressure roller 44 and the second pressure roller 45 are lower than those in the normal mode, a longer fixation time is ensured, and excellent fixation can be achieved.

In the fixing part 20, and in the pressure changeover mechanism part 46, the respective holder plates 59 are made to hold the first pressure roller 44 and the second pressure roller 45, and the changeover of the pressing force between the normal mode and the envelope mode is realized by swing of the respective holder plates 59, and therefore, the pressing forces of the first pressure roller 44 and the second pressure roller 45 to the heat roller 42 can be changed over simultaneously.

Since each of the holder plates 59 is swung while the front end part at the conveyance direction upstream side with respect to the first pressure roller 44 is made the fulcrum, the second pressure roller 45 can be displaced more than the first pressure roller 44 by merely swinging the respective holder plates 59. Thus, by the simple structure, the normal mode and the envelope mode can be changed over so that the ratio of the pressing force per unit area of the second pressure roller 45 becomes smaller than the ratio the pressing force per unit area of the first pressure roller 44, and both the pressing force per unit area of the first pressure roller 44 and the pressing force per unit area of the second pressure roller 45 become low without fail.

In the pressure changeover mechanism part 46, when the operator merely holds the operation rod 80 of the lever 76 to operate it in the vertical direction, the selective changeover of the normal mode, the envelope mode and the release mode can be realized, and therefore, the operationality can be improved.

Further, in the pressure changeover mechanism part 46, when the operator holds the operation rod 80 of either one of the levers 76, and presses the operation rod 80 downward from the normal mode while slightly swinging the operation rod 80 rearward, even if both the levers 76 are not operated, the respective holder plates 59 are interlocked and the release mode can be realized by the rotation of the interlocking shaft 61. Thus, while the operationality is improved, the first pressure roller 44 and the second pressure roller 45 can be swung with respect to the heat roller 42. Thus, for example, in the case where a jam of the sheet 3 occurs between the heat roller 42 and the first pressure roller 44 and the second pressure roller 45, by merely operating the operation rod 80 of either one of the levers 76, the first pressure roller 44 and the second pressure roller 45 can be separated from the heat roller 42 and efficient jam processing can be performed.

In the fixing part 20, since the material of the surface of the second pressure roller 45 is identical to the material of the surface of the first pressure roller 44, and the surface roughness Rz of the second pressure roller 45 is larger than the surface roughness Rz of the first pressure roller 44, the friction coefficient of the second pressure roller 45 to the sheet 3 is larger than the friction coefficient of the first pressure roller 44 to the sheet 3, and the sheet 3 can be certainly held between the second pressure roller 45 and the heat roller 42 and can be conveyed. Thus, the sheet 3 can be conveyed between the first pressure roller 44 and the second pressure roller 45 without being loosened, and it is possible to prevent the occurrence of wrinkles of the sheet 3 pressed to the heat roller 42 by the first pressure roller 44 and the second pressure roller 45. Even if the friction coefficient of the second pressure roller 45 to the sheet 3 is equal to the friction coefficient of the first pressure roller 44 to the sheet 3, a similar effect can be obtained.

Further, in the fixing part 20, since the material of the surface of the heat roller 42 is identical to the material of the surface of the second pressure roller 45, and the surface roughness Rz of the heat roller 42 is larger than the surface roughness Rz of the second pressure roller 45, the friction coefficient of the heat roller 42 to the sheet 3 is larger than the friction coefficient of the second pressure roller 45 to the sheet 3, and the sheet 3 is more certainly held between the second pressure roller 45 and the heat roller 42 and can be conveyed. Thus, it is possible to more certainly prevent the sheet 3 from being loosened between the first pressure roller 44 and the second pressure roller 45, and it is possible to prevent the occurrence of wrinkles of the sheet 3 pressed to the heat roller 42 by the first pressure roller 44 and the second pressure roller 45. Even if the friction coefficient of the heat roller 42 to the sheet 3 is equal to the friction coefficient of the second pressure roller 45 to the sheet 3, a similar effect can be obtained.

When the first pressure roller 44 and the second pressure roller 45 are pressed to the heat roller 42 in the fixing part 20 as stated above, there is a case where the leading end of the sheet 3 having passed through between the heat roller 42 and the first pressure roller 44 is separated from the heating roller 42 due to the curvature of the heating roller 42 and can not enter between the heating roller 42 and the second pressure roller 45, and a jam occurs.

However, in the fixing part 20, as shown in FIG. 10, since the rotation center P1 of the second pressure roller 45 is disposed at the farther side from the heating roller 42 with respect to the tangent line L1 of the heating roller 42 at the most downstream position X1 of the contact portion between the heating roller 42 and the first pressure roller 44 in the conveyance direction of the sheet 3, the leading end of the sheet 3 having passed through between the heating roller 42 and the first pressure roller 44 can be smoothly made to enter between the heat roller 42 and the second pressure roller 45. Thus, stable fixation and conveyance can be achieved by the smooth delivery of the sheet 3 from the first pressure roller 44 to the second pressure roller 45.

Since the laser printer 1 includes the fixing part 20 as described above, in addition to a normal paper, even when the sheet 3 is made of a double paper such as an envelope, an excellent image can be formed.

In the above description, in the pressure changeover mechanism part 46, the locking groove 62 of the front end part of each of the holder plates 59 is engaged with the support plate 57 of the lower frame 52, and each of the holder plates 59 is swung while the front end part at the conveyance direction upstream side with respect to the first pressure roller 44 is made the fulcrum. However, the swing fulcrum of each of the holder plates 59 may be positioned at a conveyance direction upstream side with respect to the rear side pressure roller attachment groove 65 where the second roller shaft 70 of the second pressure roller 45 in each of the holder plates 59 is held, and for example, the locking groove 62 is formed between the rear side pressure roller attachment groove 65 and the front side pressure roller attachment groove 65, the support plate 57 of the lower frame 52 is formed at a position facing that, and each of the holder plates 59 may be swung by engagement of those while a place between the rear side pressure roller attachment groove 65 and the front side pressure roller attachment groove 65 is made a fulcrum. When it is swung as described above, at the changeover from the normal mode to the envelope mode, the pressing force per unit area of the second pressure roller 45 becomes low in the envelope mode as compared with the normal mode, and the pressing force per unit area of the first pressure roller 44 becomes high in the envelope mode as compared with the normal mode.

In the above description, in the pressure changeover mechanism part 46, although the swings of the respective holder plates 59 are interlocked by the interlocking shaft 61 only in the release mode, also in the normal mode and the envelope mode, the interlocking shaft 61 or the like is provided and the interlocking may be performed.

In the above description, as compared with the normal mode, the thermal fixation temperature in the envelope mode is set to be higher and the conveyance speed therein is set to be lower through the control of the fixing heater 43 and the motor 85 by the CPU 87, however, in some cases, only one of the thermal fixation temperature and the conveyance speed may be controlled to be high or to be low, and further, both are not changed, and the control in the normal mode may be performed as it is.

In the above description, although the first pressure roller 44 and the second pressure roller 45 are made to follow the heat roller 42, for example, as indicated by a dotted line of FIG. 4, power from the motor 85 is inputted to the first roller shaft 69 and the second roller shaft 70, and the first pressure roller 44 and the second pressure roller 45 may be individually driven. In the above case, it is preferable that the peripheral speed of the second pressure roller 45 becomes higher than the peripheral speed of the first pressure roller 45 through the control by the CPU 87.

According to the control as described above, since the peripheral speed of the second pressure roller 45 becomes higher than the peripheral speed of the first pressure roller 44, a tensile force can be given to the sheet 3 between the first pressure roller 44 and the second pressure roller 45. Thus, it is possible to effectively prevent the occurrence of wrinkles of the sheet 3 pressed to the heat roller 42 by the first pressure roller 44 and the second pressure roller 45. In the control as described above, for example, the peripheral speed of the first pressure roller 44 is set to 140 mm/sec, and the peripheral speed of the second pressure roller 45 is set to about 101% of the peripheral speed of the first pressure roller 44, for example, 141.4 mm/sec.

In the above description, in the laser printer 1, at an image assurance temperature in a range of from 10° C. to 30° C., an image under the above thermal fixation conditions (thermal fixation temperature, conveyance speed, pressing forces per unit areas of the first pressure roller 44 and the second pressure roller 45 to the heat roller 42, kind of toner, etc.) is warranted. Besides, the numerical values of the specific thermal fixation conditions are based on the results obtained when a normal paper of Xerox 80g paper (A4 size) is used as the sheet 3.

According to the kind of toner, the hot offset does not occur, and such toner can also be used in this laser printer 1.

Figure 12:
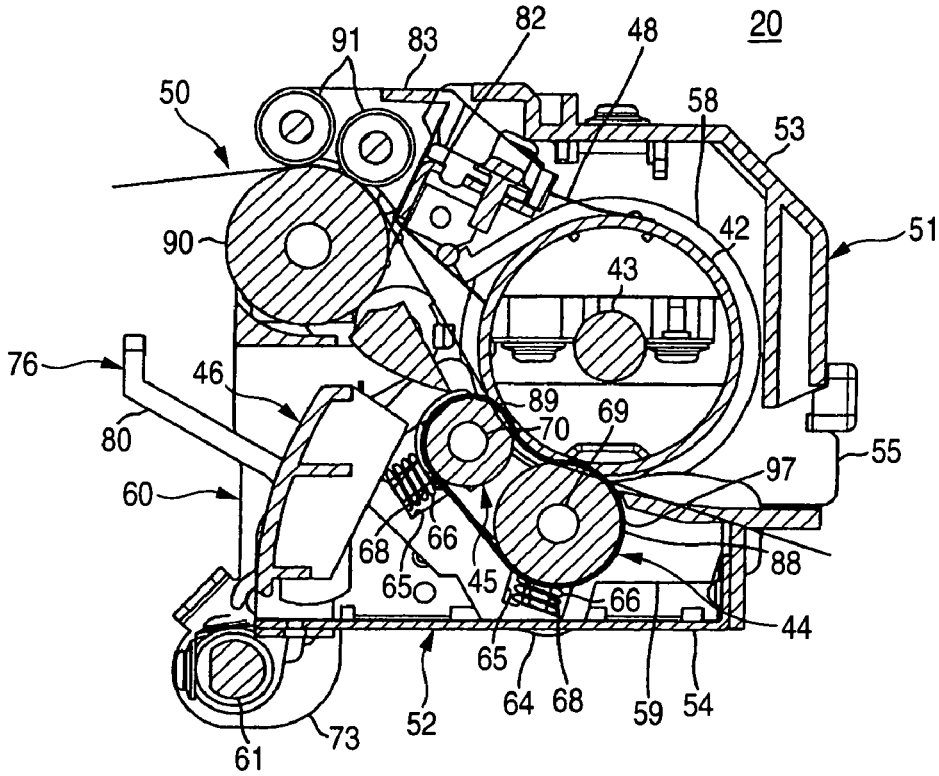
FIG. 12 is a sectional view (example in which an endless belt is mounted in the normal mode) corresponding to the line IV—IV of FIG. 3.

In the fixing part 20, for example, as shown in FIG. 12, an endless belt 97 made of heat resistant resin such as polyimide may be stretched between the outer peripheral surface of the first pressure roller 44 and the outer peripheral surface of the second pressure roller 45. By configuring as above, the performance of conveyance of the sheet 3 from the first pressure roller 44 to the second pressure roller 45 can be improved by the endless belt 97 stretched between the first pressure roller 44 and the second pressure roller 45. Thus, the certain conveyance of the sheet 3 by the first pressure roller 44 and the second pressure roller 45 is ensured, and the wrinkles of the sheet 3 and the image shift can be prevented.

Figure 13:
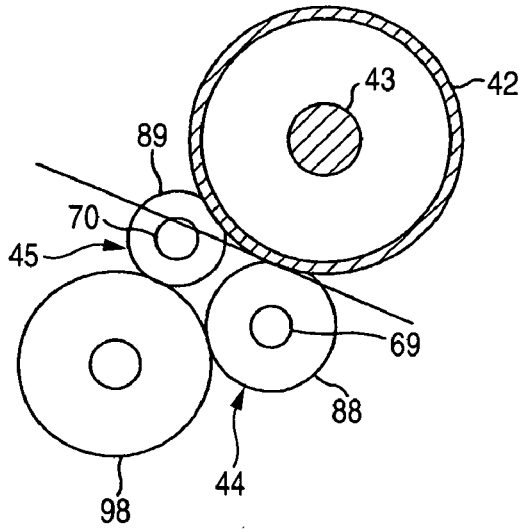
FIG. 13 is a schematic side view showing an example in which a cleaning roller is provided in the fixing part shown in FIG. 2.

In the fixing part 20, for example, as shown in FIG. 13, a cleaning roll 98 as a cleaning member may be provided which comes in contact with the first pressure roller 44 and the second pressure roller 45 and cleans the first pressure roller 44 and the second pressure roller 45.

Figure 14:
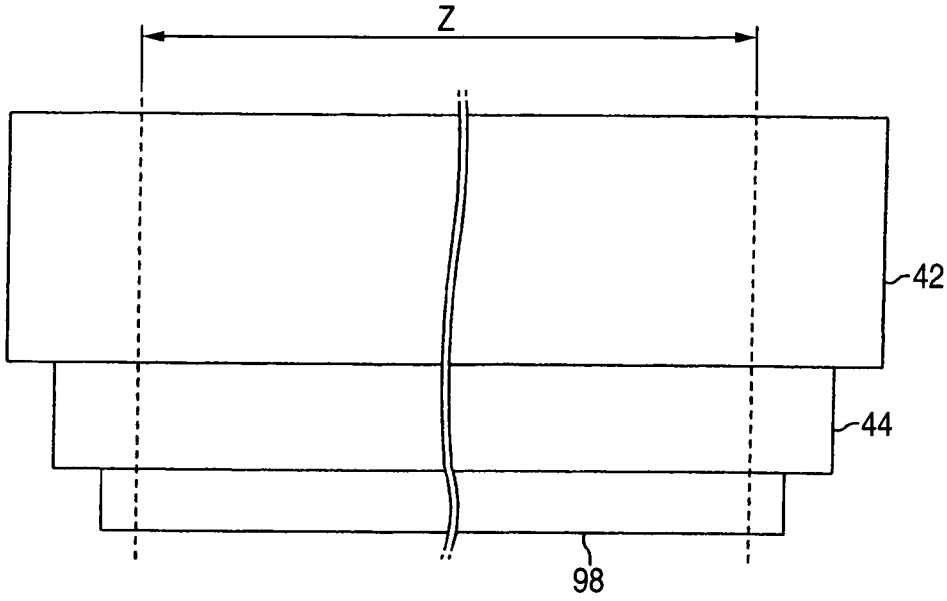
FIG. 14 is a schematic front view of the example of FIG. 13.

That is, as shown in FIG. 14, the cleaning roller 98 has an axial direction length longer than a fixation area Z (area where the sheet 3 is brought into contact) of the heat roller 42, and as shown in FIG. 13, the cleaning roller 98 is disposed below the heat roller 42 to face the fixation area Z of the heat roller 42 and to come in contact with the first pressure roller 44 and the second pressure roller 45 at the lower part.

The cleaning roller 98 is such that a roller made of conductive rubber material covers a roller shaft made of metal, and foreign matter adhered to the first pressure roller 44 and the second pressure roller 45 is collected by the cleaning roller 98.

As described above, when the cleaning roller 98 is provided in this way, both the first pressure roller 44 and the second pressure roller 45 can be cleaned by the common cleaning roller 98. Thus, the number of parts can be reduced, and the simplification and miniaturization of the device structure can be realized.

When the cleaning roller 98 is disposed as described above, it is possible to form the closed space surrounded by the heat roller 42, the cleaning roller 98 opposite to that, the first pressure roller 44 and the second pressure roller 45 which press the heat roller 42 and with which the cleaning roller 98 is brought into contact. Thus, since the heat radiation of the fixation area Z of the heat roller 42 can be suppressed, a temperature rise in the device can be prevented while efficient fixation is performed.

Figure 15:
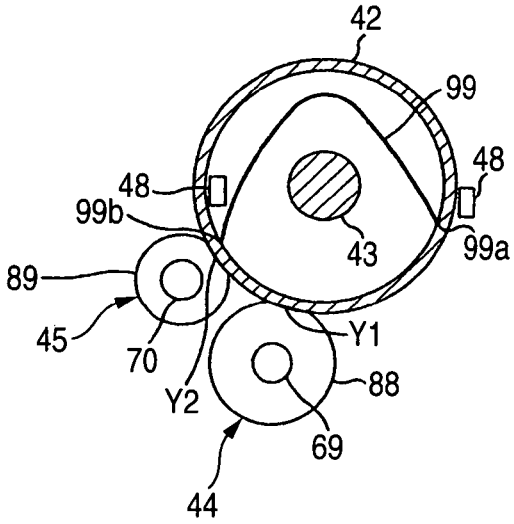
FIG. 15 is a schematic side view showing an example in which a reflector and two thermistors are provided in the fixing part shown in FIG. 2.

In the fixing part 20, as shown in FIG. 15, a reflector 99 as a reflecting member may be provided at the inside of the heat roller 42, and thermistors 48 may be respectively provided at the inside and the outside of the heat roller 42.

The reflector 99 is made of metal or the like reflecting heat, is formed into a substantially V-letter shape, and is disposed along the axial direction of the heat roller 42. One end part 99*a* of the reflector 99 is disposed in the vicinity of a position at an upstream side of a contact portion Y1 between the heat roller 42 and the first pressure roller 44 in the rotation direction of the heat roller 42, and the other end part 99*b* is disposed in the vicinity of a position at the most downstream of a contact portion Y2 between the heat roller 42 and the second pressure roller 45 in the rotation direction of the heat roller 42. Accordingly, heat emitted from the fixing heater 43 and heat emitted from the fixing heater 43 and reflected by the reflector 99 are irradiated to the area of the heat roller 42 surrounded by the one end part 99*a* and the other end part 99*b* of the reflector 99.

Thus, the respective contact portions of the first pressure roller 44 and the second pressure roller 45 to the heat roller 42 can be efficiently heated. As a result, the warm-up time of the fixing part 20 can be shortened and the running cost can be reduced.

One of the thermistors 48 is provided inside of the heat roller 42 and outside of the area of the heat roller 42 where the heat reflected by the reflector 99 is irradiated, more specifically, in the vicinity of the outside of the other end part 99*b* of the reflector 99. The other thereof is provided in the area of the heat roller 42 where the heat reflected by the reflector 99 is irradiated, more specifically, in the vicinity of the inside of the one end part 99*a* of the reflector 99. Accordingly, it becomes possible to accurately detect the temperature of the heat roller 42, and quick and certain fixation can be achieved by the first pressure roller 44 and the second pressure roller 45.

As described above, according to a first aspect of the invention, there is provided a thermal fixing device including: a fixing member configured to be in contact with a fixation medium; a first pressing member disposed to face the fixing member and presses the fixation medium to the fixing member; a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member.

According to the first aspect of the invention, the pressing force per unit area of at least one of the first pressing member and the second pressing member to the fixing member can be changed over by the changeover unit according to the kind of the fixation medium. Thus, by suitably changing over the pressing force per unit area of at least one of the first pressing member and the second pressing member to the fixing member according to the kind of the fixation medium, it is possible to prevent the occurrence of wrinkles of the fixation medium pressed to the fixing member by the first pressing member and the second pressing member.

According to a second aspect of the invention, in addition to the first aspect of the invention, the changeover unit changes over the pressing force per unit area of the first pressing member and the pressing force per unit area of the second pressing member between a first state and a second state in which the pressing force per unit area of the first pressing member and the pressing force per unit area of the second pressing member are lower than those in the first state.

According to the second aspect of the invention, when a changeover to the first state is performed in the case where a normal paper as the fixation medium is to be fixed, and when a changeover to the second state is performed in the case where an envelope or the like as the fixation medium is to be fixed, in the case where the envelope or the like is fixed, as compared with the case where the normal paper or the like is fixed, the pressing force per unit area of the first pressing member and the pressing force per unit area of the second pressing member can be made low. Thus, the normal paper or the like is fixed, and fixation can be performed while the occurrence of wrinkles of the envelope or the like is prevented.

According to a third aspect of the invention, in addition to the second aspect of the invention, the changeover unit performs the changeover so that a ratio of the pressing force per unit area of the second pressing member in the second state to the pressing force per unit area of the second pressing member in the first state is smaller than a ratio of the pressing force per unit area of the first pressing member in the second state to the pressing force per unit area of the first pressing member in the first state.

According to the third aspect of the invention, at the changeover between the first state and the second state, since the ratio of the pressing force per unit area of the second pressing member is smaller than the ratio of the pressing force per unit area of the first pressing member, a rate at which the pressing force per unit area of the second pressing member becomes low is increased in the second state. Thus, in the second state, in the case where the envelope or the like is fixed, while the fixation is performed by the first pressing member, the pressing force per unit area of the second pressing member is made low, and the occurrence of wrinkles can be prevented.

According to a fourth aspect of the invention, in addition to the second aspect of the invention, the thermal fixing device further includes: a heating unit that generates heat for heating the fixing member by applied electricity; a detecting unit that detects temperature of the fixing member; and a controller that controls the heating unit on the basis of the temperature of the fixing member detected by the detecting unit, wherein the controller controls, in the first state, the heating unit so that the temperature of the fixing member for fixing onto the fixation medium a medium to be fixed is set to a first temperature, and controls, in the second state, the heating unit so that the temperature of the fixing member for fixing onto the fixation medium the medium to be fixed is set to a second temperature higher than the first temperature.

According to the fourth aspect of the invention, in the second state, since the temperature of the fixing member becomes the second temperature higher than the first temperature in the first state, even if the pressing forces per unit areas of the first pressing member and the second pressing member in the second state are lower than those in the first state, the higher fixing temperature is ensured and excellent fixation can be achieved.

According to a fifth aspect of the invention, in addition to the second aspect of the invention, the thermal fixing device further includes: a driving unit that drives the first pressing member and the second pressing member; and a controller that controls the driving unit to control a conveyance speed of the fixation medium held between the fixing member, the first pressing member and the second pressing member, wherein the controller controls the driving unit so that in the first state, the conveyance speed is set to a first conveyance speed, and controls the driving unit so that in the second state, the conveyance speed is set to a second conveyance speed lower than the first conveyance speed.

According to the fifth aspect of the invention, in the second state, since the conveyance speed becomes the second conveyance speed lower than the first conveyance speed, even if the pressing forces per unit areas of the first pressing member and the second pressing member in the second state are lower than those in the first state, a longer fixation time is ensured and excellent fixation can be achieved.

According to a sixth aspect of the invention, in addition to the first aspect of the invention, the changeover unit includes: a holding member that holds the first pressing member and the second pressing member; a supporting member that swingably supports the holding member at a position upstream in the conveyance direction of the fixation medium with respect to a holding portion of the holding member for the second pressing member; and a swinging member that swings the holding member using the supporting member as a fulcrum.

According to the sixth aspect of the invention, since the first pressing member and the second pressing member are held by the holding member, the pressing forces per unit areas of the first pressing member and the second pressing member to the fixing member can be simultaneously changed by swinging the holding member. Besides, when the holding member is swung by the swinging member, since the holding member is swung while the supporting member is made the fulcrum at the upstream side in the conveyance direction of the fixation medium with respect to the holding portion to the second pressing member, the first state and the second state can be changed over by the simple structure so that the ratio of the pressing force per unit area of the second pressing member becomes smaller than the ratio of the pressing force per unit area of the first pressing member.

According to a seventh aspect of the invention, in addition to the sixth aspect of the invention, the supporting member supports the holding member swingably at a position upstream in the conveyance direction of the fixation medium with respect to a holding portion of the holding member for the first pressing member.

According to the seventh aspect of the invention, since the holding member is swung while the supporting member is used as a fulcrum at the upstream side in the conveyance direction of the fixation medium with respect to the holding portion to the first pressing member, at the changeover from the first state to the second state, while the ratio of the pressing force per unit area of the second pressing member is made smaller than the ratio of the pressing force per unit area of the first pressing member, the pressing force per unit area of the first pressing member and the pressing force per unit area of the second pressing member can be made low by the simple structure.

According to an eighth aspect of the invention, in addition to the first aspect of the invention, the changeover unit includes an operation member configured to be operated by an operator to change over the pressing force per unit area of at least one of the first pressing member and the second pressing member.

According to the eighth aspect of the invention, since the operator can change over the pressing force per unit area of the first pressing member and/or the second pressing member to the fixing member by operating the operation member, the operationality can be improved.

According to a ninth aspect of the invention, in addition to the eighth aspect of the invention, the holding member is provided at each of both ends of the first pressing member and the second pressing member in a longitudinal direction, and wherein the changeover unit includes an interlocking member for swinging the respective holding members in conjunction with each other by the operation of the operation member.

According to the ninth aspect of the invention, when the operation member is operated, the holding members respectively provided at both the ends of the first pressing member and the second pressing member in the longitudinal direction can be swung in conjunction with each other by the interlocking of the interlocking member. Thus, while the operationality is improved, the first pressing member and the second pressing member can be swung with respect to the fixing member.

According to a tenth aspect of the invention, in addition to the first aspect of the invention, a friction coefficient of the second pressing member to the fixation medium is equal to or larger than a friction coefficient of the first pressing member to the fixation medium.

According to the tenth aspect of the invention, since the friction coefficient of the second pressing member to the fixation medium is equal to or larger than the friction coefficient of the first pressing member to the fixation medium, the fixation medium can be held between the second pressing member and the fixing member and can be conveyed. Thus, the fixation medium can be conveyed between the first pressing member and the second pressing member without being loosened, and it is possible to prevent the occurrence of wrinkles of the fixation medium pressed to the fixing member by the first pressing member and the second pressing member.

According to an eleventh aspect of the invention, in addition to the tenth aspect of the invention, a friction coefficient of the fixing member to the fixation medium is equal to or larger than the friction coefficient of the second pressing member to the fixation medium.

According to the eleventh aspect of the invention, since the friction coefficient of the fixing member to the fixation medium is equal to or larger than the friction coefficient of the second pressing member to the fixation medium, the fixation medium can be conveyed while being more certainly held between the second pressing member and the fixing member. Thus, it is possible to more effectively prevent the fixation medium from being loosened between the first pressing member and the second pressing member, and it is possible to more effectively prevent the occurrence of wrinkles of the fixation medium pressed to the fixing member by the first pressing member and the second pressing member.

According to a twelfth aspect of the invention, in addition to the first aspect of the invention, the fixing member includes a fixing roller, the first pressing member includes a first pressure roller, and the second pressing member includes a second pressure roller, and wherein a rotation center of the second pressure roller is disposed at a farther side from the fixing roller with respect to a tangent line of the fixing roller at a most downstream position of a contact portion between the fixing roller and the first pressure roller in the conveyance direction of the fixation medium.

When a first pressure roller and a second pressure roller are pressed to a fixing roller, there is a case where a leading end of a fixation medium having passed through between the fixing roller and the first pressure roller is separated from the fixing roller due to the curvature of the fixing roller and can not enter between the fixing roller and the second pressure roller, and a jam occurs.

However, according to the twelfth aspect of the invention, since the rotation center of the second pressure roller is disposed at the farther side from the fixing roller with respect to the tangent line of the fixing roller at the most downstream position of the contact portion between the fixing roller and the first pressure roller in the conveyance direction of the fixation medium, the leading end of the fixation medium having passed through between the fixing roller and the first pressure roller can be smoothly made to enter between the fixing roller and the second pressure roller. Thus, stable fixation and conveyance can be achieved by the smooth delivery of the fixation medium from the first pressure roller to the second pressure roller.

According to a thirteenth aspect of the invention, in addition to the first aspect of the invention, the first pressing member includes a first pressure roller, the second pressing member includes a second pressure roller, wherein the thermal fixing device further includes a driving unit that drives the first pressure roller and the second pressure roller, and a controller that controls the driving unit, and wherein the controller controls the driving unit so that a peripheral speed of the second pressure roller is higher than a peripheral speed of the first pressure roller.

According to the thirteenth aspect of the invention, since the peripheral speed of the second pressure roller becomes higher than the peripheral speed of the first pressure roller, a tensile force can be given to the fixation medium between the first pressure roller and the second pressure roller. Thus, it is possible to prevent the occurrence of wrinkles of the fixation medium pressed to the fixing member by the first pressure roller and the second pressure roller.

According to a fourteenth aspect of the invention, in addition to the first aspect of the invention, the thermal fixing device further includes a cleaning member configured to be in contact with the first pressing member and the second pressing member and cleans the first pressing member and the second pressing member.

According to the fourteenth aspect of the invention, both the first pressing member and the second pressing member can be cleaned by the common cleaning member. Thus, it is possible to reduce the number of parts and to realize the simplification and miniaturization of the device structure.

According to a fifteenth aspect of the invention, in addition to the fourteenth aspect of the invention, the fixing member has a fixation area configured to be in contact with the fixation medium, and wherein the cleaning member is disposed to face the fixing member and has a length longer than the fixation area in a longitudinal direction.

According to the fifteenth aspect of the invention, it is possible to form a closed space surrounded by the fixing member, the cleaning member opposite to that, the first pressure roller and the second pressure roller which press the fixing member and with which the cleaning member is brought into contact. Thus, since heat radiation of the fixation area at the fixing member can be suppressed, a temperature rise in the device can be prevented, while efficient fixation is realized.

According to a sixteenth aspect of the invention, in addition to the first aspect of the invention, the thermal fixing device further includes an endless belt stretched between the first pressing member and the second pressing member.

According to the sixteenth aspect of the invention, the performance of conveyance of the fixation medium from the first pressing member to the second pressing member can be improved by the endless belt stretched between the first pressing member and the second pressing member. Thus, it is possible to more effectively prevent the occurrence of wrinkles of the fixation medium pressed to the fixing member by the first pressing member and the second pressing member.

According to a seventeenth aspect of the invention, there is provided a thermal fixing device including: a fixing member configured to be in contact with a fixation medium; a first pressing member disposed to face the fixing member and presses the fixation medium to the fixing member; and a second pressing member disposed to face the fixing member at a position downstream in a conveyance direction of the fixation medium with respect to the first pressing member and presses the fixation medium to the fixing member, wherein a friction coefficient of the second pressing member to the fixation medium is equal to or larger than a friction coefficient of the first pressing member to the fixation medium.

According to the seventeenth aspect of the invention, since the friction coefficient of the second pressing member to the fixation medium is equal to or larger than the friction coefficient of the first pressing member to the fixation medium, the fixation medium can be held between the second pressing member and the fixing member and can be conveyed. Thus, the fixation medium can be conveyed between the first pressing member and the second pressing member without being loosened, and it is possible to prevent the occurrence of wrinkles of the fixation medium pressed to the fixing member by the first pressing member and the second pressing member.

According to an eighteenth aspect of the invention, in addition to the seventeenth aspect of the invention, a friction coefficient of the fixing member to the fixation medium is equal to or larger than the friction coefficient of the second pressing member to the fixation medium.

According to the eighteenth aspect of the invention, since the friction coefficient of the fixing member to the fixation medium is equal to or larger than the friction coefficient of the second pressing member to the fixation medium, the fixation medium can be conveyed while being more certainly held between the second pressing member and the fixing member. Thus, it is possible to more effectively prevent the fixation medium from being loosened between the first pressing member and the second pressing member, and it is possible to more effectively prevent the occurrence of wrinkles of the fixation medium pressed to the fixing member by the first pressing member and the second pressing member.

According to a nineteenth aspect of the invention, in addition to the seventeenth aspect of the invention, the fixing member includes a fixing roller, the first pressing member includes a first pressure roller, and the second pressing member includes a second pressure roller, and wherein a rotation center of the second pressure roller is disposed at a farther side from the fixing roller with respect to a tangent line of the fixing roller at a most downstream position of a contact portion between the fixing roller and the first pressure roller in the conveyance direction of the fixation medium.

When a first pressure roller and a second pressure roller are pressed to a fixing roller, there is a case where a leading end of a fixation medium having passed through between the fixing roller and the first pressure roller is separated from the fixing roller due to the curvature of the fixing roller and can not enter between the fixing roller and the second pressure roller, and a jam occurs.

However, according to the nineteenth aspect of the invention, since the rotation center of the second pressure roller is disposed at the farther side from the fixing roller with respect to the tangent line of the fixing roller at the most downstream position of the contact portion between the fixing roller and the first pressure roller in the conveyance direction of the fixation medium, the leading end of the fixation medium having passed through between the fixing roller and the first pressure roller can be smoothly made to enter between the fixing roller and the second pressure roller. Thus, stable fixation and conveyance can be achieved by the smooth delivery of the fixation medium from the first pressure roller to the second pressure roller.

According to a twentieth aspect of the invention, in addition to the seventeenth aspect of the invention, the first pressing member includes a first pressure roller, the second pressing member includes a second pressure roller, wherein the thermal fixing device further includes a driving unit that drives the first pressure roller and the second pressure roller, and a controller that controls the driving unit, and wherein the controller controls the driving unit so that a peripheral speed of the second pressure roller is higher than a peripheral speed of the first pressure roller.

According to the twentieth aspect of the invention, since the peripheral speed of the second pressure roller becomes higher than the peripheral speed of the first pressure roller, a tensile force can be given to the fixation medium between the first pressure roller and the second pressure roller. Thus, it is possible to prevent the occurrence of wrinkles of the fixation medium pressed to the fixing member by the first pressure roller and the second pressure roller.

According to a twenty-first aspect of the invention, in addition to the seventeenth aspect of the invention, the thermal fixing device further includes a cleaning member configured to be in contact with the first pressing member and the second pressing member and cleans the first pressing member and the second pressing member.

According to the twenty-first aspect of the invention, both the first pressing member and the second pressing member can be cleaned by the common cleaning member. Thus, it is possible to reduce the number of parts and to realize the simplification and miniaturization of the device structure.

According to a twenty-second aspect of the invention, in addition to the twenty-first aspect of the invention, the fixing member has a fixation area configured to be in contact with the fixation medium, and wherein the cleaning member is disposed to face the fixing member and has a length longer than the fixation area in a longitudinal direction.

According to the twenty-second aspect of the invention, it is possible to form a closed space surrounded by the fixing member, the cleaning member opposite to that, the first pressure roller and the second pressure roller which press the fixing member and with which the cleaning member is brought into contact. Thus, since heat radiation of the fixation area at the fixing member can be suppressed, a temperature rise in the device can be prevented, while efficient fixation is realized.

According to a twenty-third aspect of the invention, in addition to the seventeenth aspect of the invention, the thermal fixing device further includes an endless belt stretched between the first pressing member and the second pressing member.

According to the twenty-third aspect of the invention, the performance of conveyance of the fixation medium from the first pressing member to the second pressing member can be improved by the endless belt stretched between the first pressing member and the second pressing member. Thus, it is possible to more effectively prevent the occurrence of wrinkles of the fixation medium pressed to the fixing member by the first pressing member and the second pressing member.

According to a twenty-fourth aspect of the invention, there is provided an image forming apparatus including: a sheet feeding section configured to feed a sheet as a fixation medium; and an image forming section having a thermal fixing device and configured to form an image on the sheet fed by the sheet feeding section, wherein the thermal fixing device includes: a fixing member configured to be in contact with a fixation medium; a first pressing member disposed to face the fixing member and presses the fixation medium to the fixing member; a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member.

According to a twenty-fifth aspect of the invention, there is provided an image forming apparatus including: a sheet feeding section configured to feed a sheet as a fixation medium; and an image forming section having a thermal fixing device and configured to form an image on the sheet fed by the sheet feeding section, wherein the thermal fixing device includes: a fixing member configured to be in contact with a fixation medium; a first pressing member disposed to face the fixing member and presses the fixation medium to the fixing member; and a second pressing member disposed to face the fixing member at a position downstream in a conveyance direction of the fixation medium with respect to the first pressing member and presses the fixation medium to the fixing member, wherein a friction coefficient of the second pressing member to the fixation medium is equal to or larger than a friction coefficient of the first pressing member to the fixation medium.

According to the twenty-fourth and the twenty-fifth aspects of invention, since the image forming apparatus as stated above includes the thermal fixing device which can prevent the occurrence of wrinkles of the fixation medium, an image can be excellently formed even for the fixation medium made of a double paper such as an envelope.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A thermal fixing device comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member;

wherein the changeover unit changes over the pressing force per unit area of the first pressing member and the pressing force per unit area of the second pressing member between a first state and a second state in which the pressing force per unit area of the first pressing member and the pressing force per unit area of the second pressing member are lower than those in the first state.

2. The thermal fixing device as claimed in claim 1, wherein the changeover unit performs the changeover so that a ratio of the pressing force per unit area of the second pressing member in the second state to the pressing force per unit area of the second pressing member in the first state is smaller than a ratio of the pressing force per unit area of the first pressing member in the second state to the pressing force per unit area of the first pressing member in the first state.

3. The thermal fixing device as claimed in claim 1 further comprising:

a heating unit that generates heat for heating the fixing member by applied electricity;

a detecting unit that detects temperature of the fixing member; and a controller that controls the heating unit on the basis of the temperature of the fixing member detected by the detecting unit, wherein the controller controls, in the first state, the heating unit so that the temperature of the fixing member for fixing onto the fixation medium a medium to be fixed is set to a first temperature, and controls, in the second state, the heating unit so that the temperature of the fixing member for fixing onto the fixation medium the medium to be fixed is set to a second temperature higher than the first temperature.

4. The thermal fixing device as claimed in claim 1 further comprising:

a driving unit that drives the first pressing member and the second pressing member; and a controller that controls the driving unit to control a conveyance speed of the fixation medium held between the fixing member, the first pressing member and the second pressing member, wherein the controller controls the driving unit so that in the first state, the conveyance speed is set to a first conveyance speed, and controls the driving unit so that in the second state, the conveyance speed is set to a second conveyance speed lower than the first conveyance speed.

5. A thermal fixing device comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member;

wherein the changeover unit comprises:

a holding member that holds the first pressing member and the second pressing member;

a supporting member that swingably supports the holding member at a position upstream in the conveyance direction of the fixation medium with respect to a holding portion of the holding member for the second pressing member; and a swinging member that swings the holding member using the supporting member as a fulcrum.

6. The thermal fixing device as claimed in claim 5, wherein the supporting member supports the holding member swingably at a position upstream in the conveyance direction of the fixation medium with respect to a holding portion of the holding member for the first pressing member.

7. A thermal fixing device comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member;

wherein the changeover unit comprises an operation member configured to be operated by an operator to change over the pressing force per unit area of at least one of the first pressing member and the second pressing member.

8. The thermal fixing device as claimed in claim 7, wherein a holding member is provided at each of both ends of the first pressing member and the second pressing member in a longitudinal direction, and wherein the changeover unit comprises an interlocking member for swinging a respective holding members in conjunction with each other by the operation of the operation member.

9. A thermal fixing device comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member;

wherein a friction coefficient of the second pressing member to the fixation medium is equal to or larger than a friction coefficient of the first pressing member to the fixation medium.

10. The thermal fixing device as claimed in claim 9, wherein a friction coefficient of the fixing member to the fixation medium is equal to or larger than the friction coefficient of the second pressing member to the fixation medium.

11. A thermal fixing device comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member;

wherein the first pressing member comprises a first pressure roller, the second pressing member comprises a second pressure roller, wherein the thermal fixing device further comprises a driving unit that drives the first pressure roller and the second pressure roller, and a controller that controls the driving unit, and wherein the controller controls the driving unit so that a peripheral speed of the second pressure roller is higher than a peripheral speed of the first pressure roller.

12. A thermal fixing device comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member;

a changeover unit configured to change over a pressing force per unit area of at least one of the first pressing member and the second pressing member; and a cleaning member configured to be in contact with the first pressing member and the second pressing member and cleans the first pressing member and the second pressing member.

13. The thermal fixing device as claimed in claim 12, wherein the fixing member has a fixation area configured to be in contact with the fixation medium, and wherein the cleaning member is disposed to face the fixing member and has a length longer than the fixation area in a longitudinal direction.

14. A thermal fixing device comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member;

a changeover unit configured to change over a pressing force per unit area of at least one of the first pressing member and the second pressing member; and an endless belt stretched between the first pressing member and the second pressing member.

15. A thermal fixing device comprising:

a fixing member configured to be in contact with a fixation medium;

a first pressing member disposed to face the fixing member and presses the fixation medium to the fixing member; and a second pressing member disposed to face the fixing member at a position downstream in a conveyance direction of the fixation medium with respect to the first pressing member and presses the fixation medium to the fixing member, wherein a friction coefficient of the second pressing member to the fixation medium is equal to or larger than a friction coefficient of the first pressing member to the fixation medium.

16. The thermal fixing device as claimed in claim 15, wherein a friction coefficient of the fixing member to the fixation medium is equal to or larger than the friction coefficient of the second pressing member to the fixation medium.

17. The thermal fixing device as claimed in claim 15, wherein the fixing member comprises a fixing roller, the first pressing member comprises a first pressure roller, and the second pressing member comprises a second pressure roller, and wherein a rotation center of the second pressure roller is disposed at a farther side from the fixing roller with respect to a tangent line of the fixing roller at a most downstream position of a contact portion between the fixing roller and the first pressure roller in the conveyance direction of the fixation medium.

18. The thermal fixing device as claimed in claim 15, wherein the first pressing member comprises a first pressure roller, the second pressing member comprises a second pressure roller, wherein the thermal fixing device further comprises a driving unit that drives the first pressure roller and the second pressure roller, and a controller that controls the driving unit, and wherein the controller controls the driving unit so that a peripheral speed of the second pressure roller is higher than a peripheral speed of the first pressure roller.

19. The thermal fixing device as claimed in claim 15 further comprising a cleaning member configured to be in contact with the first pressing member and the second pressing member and cleans the first pressing member and the second pressing member.

20. The thermal fixing device as claimed in claim 19, wherein the fixing member has a fixation area configured to be in contact with the fixation medium, and wherein the cleaning member is disposed to face the fixing member and has a length longer than the fixation area in a longitudinal direction.

21. The thermal fixing device as claimed in claim 15 further comprises an endless belt stretched between the first pressing member and the second pressing member.

22. An image forming apparatus comprising:

a sheet feeding section configured to feed a sheet as a fixation medium; and an image forming section having a thermal fixing device and configured to form an image on the sheet fed by the sheet feeding section, wherein the thermal fixing device comprises:

a fixing member configured to be in contact with a fixation medium;

a first pressing member disposed to face the fixing member and presses the fixation medium to the fixing member; and a second pressing member disposed to face the fixing member at a position downstream in a conveyance direction of the fixation medium with respect to the first pressing member and presses the fixation medium to the fixing member, wherein a friction coefficient of the second pressing member to the fixation medium is equal to or larger than a friction coefficient of the first pressing member to the fixation medium.

23. An image forming apparatus comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member;

wherein the changeover unit changes over the pressing force per unit area of the first pressing member and the pressing force per unit area of the second pressing member between a first state and a second state in which the pressing force per unit area of the first pressing member and the pressing force per unit area of the second pressing member are lower than those in the first state.

24. An image forming apparatus comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member;

wherein the changeover unit comprises:

a holding member that holds the first pressing member and the second pressing member;

a supporting member that swingably supports the holding member at a position upstream in the conveyance direction of the fixation medium with respect to a holding portion of the holding member for the second pressing member; and a swinging member that swings the holding member using the supporting member as a fulcrum.

25. An image forming apparatus comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member;

wherein the changeover unit comprises an operation member configured to be operated by an operator to change over the pressing force per unit area of at least one of the first pressing member and the second pressing member.

26. An image forming apparatus comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member;

wherein a friction coefficient of the second pressing member to the fixation medium is equal to or larger than a friction coefficient of the first pressing member to the fixation medium.

27. An image forming apparatus comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member; and a changeover unit configured to change over a pressing force per unit area of at least one of the first pressing member and the second pressing member;

wherein the first pressing member comprises a first pressure roller, the second pressing member comprises a second pressure roller, wherein the image forming apparatus further comprises a driving unit that drives the first pressure roller and the second pressure roller, and a controller that controls the driving unit, and wherein the controller controls the driving unit so that a peripheral speed of the second pressure roller is higher than a peripheral speed of the first pressure roller.

28. An image forming apparatus comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member;

a changeover unit configured to change over a pressing force per unit area of at least one of the first pressing member and the second pressing member; and a cleaning member configured to be in contact with the first pressing member and the second pressing member and cleans the first pressing member and the second pressing member.

29. An image forming apparatus comprising:

a fixing member configured to be in contact with a fixation medium;

a first pressing member disposed to face the fixing member and presses the fixation medium to the fixing member;

a second pressing member disposed to face the fixing member at a position downstream in a conveyance direction of the fixation medium with respect to the first pressing member and presses the fixation medium to the fixing member;

a changeover unit configured to change over a pressing force per unit area of at least one of the first pressing member and the second pressing member; and an endless belt stretched between the first pressing member and the second pressing member.

* * * * *